US010035241B2

(12) United States Patent
Kaga et al.

(10) Patent No.: US 10,035,241 B2
(45) Date of Patent: Jul. 31, 2018

(54) SHOT PROCESSING APPARATUS AND PROJECTOR

(71) Applicant: SINTOKOGIO, LTD., Nagoya-shi, Aichi (JP)

(72) Inventors: Hideaki Kaga, Toyokawa (JP); Hiroaki Suzuki, Toyokawa (JP); Shoichi Yamamoto, Toyokawa (JP); Masato Umeoka, Toyokawa (JP); Takuya Koyama, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 0 days.

(21) Appl. No.: 15/321,556

(22) PCT Filed: Jun. 8, 2015

(86) PCT No.: PCT/JP2015/066447
§ 371 (c)(1),
(2) Date: Dec. 22, 2016

(87) PCT Pub. No.: WO2015/198844
PCT Pub. Date: Dec. 30, 2015

(65) Prior Publication Data

US 2017/0144269 A1 May 25, 2017

(30) Foreign Application Priority Data

Jun. 24, 2014 (JP) ..... 2014-129579

(51) Int. Cl.
*B24C 3/18* (2006.01)
*B24C 3/24* (2006.01)
(Continued)

(52) U.S. Cl.
CPC ..... *B24C 3/14* (2013.01); *B24C 3/18* (2013.01); *B24C 3/24* (2013.01); *B24C 5/06* (2013.01); *B24C 9/00* (2013.01)

(58) Field of Classification Search
CPC .... B24C 3/14; B24C 3/18; B24C 3/24; B24C 3/26; B24C 3/30; B24C 5/06
(Continued)

(56) References Cited

U.S. PATENT DOCUMENTS 2,108,210 A * 2/1938 Rosenberger ..... B24C 3/30 451/102
2,116,160 A * 5/1938 Rosenberger ..... B24C 3/30 451/2
(Continued)

FOREIGN PATENT DOCUMENTS

CN 102548713 A 7/2012
DE 39 35 801 A1 5/1990
(Continued)

OTHER PUBLICATIONS

International Search Report, and English language translation thereof, in corresponding International Application No. PCT/JP2015/066447, dated Aug. 18, 2015, 6 pages.
(Continued)

*Primary Examiner* — Eileen Morgan
(74) *Attorney, Agent, or Firm* — Brinks Gilson & Lione

(57) ABSTRACT

The purpose of the present invention is to provide a shot processing device and a projector such that the projection amount of a projection material can be minimized. The present invention provides a shot processing device equipped with a centrifugal projector for projecting a projection material onto a workpiece and a support mechanism for supporting the workpiece at a processing position where surface processing by the projector can be carried out, wherein the projector is equipped with: a cylindrical control cage which the projection material is supplied into and which has an opening formed on a side wall as a projection material discharge port; and an impeller that has a plurality of blades, which are arranged outside of the control cage and
(Continued)

extend outward in the radial direction of the control cage, and rotates about the central axis of the control cage, wherein each blade has, disposed on a front-side surface in the rotation direction, a rearward inclined section inclining toward the rear-side in the rotation direction.

17 Claims, 26 Drawing Sheets

(51) Int. Cl.
*B24C 5/06* (2006.01)
*B24C 3/14* (2006.01)
*B24C 9/00* (2006.01)

(58) Field of Classification Search
USPC ..... 451/95, 97
See application file for complete search history.

(56) References Cited

U.S. PATENT DOCUMENTS 2,131,767 A * 10/1938 Turnbull ..... B24C 3/085 451/81
2,132,311 A * 10/1938 Minich ..... B24C 3/14 451/80
2,204,634 A * 6/1940 Turnbull ..... B24C 5/062 451/98
2,224,647 A * 12/1940 Grocholl ..... B24C 3/04 451/95
2,440,819 A * 5/1948 Evans ..... B24C 3/30 451/3
2,449,745 A * 9/1948 Jewell ..... B24C 3/30 451/86
2,732,666 A * 1/1956 Powell ..... B24C 5/06 451/94
3,653,239 A * 4/1972 Carpenter, Jr. ..... B24C 5/068 72/53
3,678,629 A * 7/1972 Leliaert ..... B24C 5/062 451/97
3,683,556 A * 8/1972 Leliaert ..... B24C 5/062 451/97
3,694,963 A * 10/1972 Leliaert ..... B24C 5/062 451/97
3,841,025 A * 10/1974 Maeda ..... B24C 5/068 451/95
4,034,516 A * 7/1977 Maeda ..... B24C 5/06 241/275
4,277,965 A * 7/1981 Rutten ..... B24C 5/062 451/98
4,366,690 A * 1/1983 Rutten ..... B24C 5/062 72/53
2012/0168355 A1 7/2012 Neuwirth
2012/0252327 A1 10/2012 Kobayashi et al.
2013/0017767 A1* 1/2013 Suzuki ..... B24C 3/085 451/86
2016/0271754 A1 9/2016 Suzuki et al.

FOREIGN PATENT DOCUMENTS

EP 2 474 361 A2 7/2012
EP 3 064 319 A1 9/2016
GB 2 276 341 A 9/1994
JP 51-1592 Y2 1/1976
JP S54-89391 A 7/1979
JP S59-116153 8/1984
JP S60-157167 10/1985
JP 2013-512112 A 4/2013
KR 2005-0005577 A 1/2005
WO WO2015/064262 A1 5/2015

OTHER PUBLICATIONS

Extended Search Report in European Application No. 15810805.0 dated Feb. 7, 2018, 8 pages.

* cited by examiner

SHOT PROCESSING APPARATUS AND PROJECTOR

This application is a 371 application of PCT/JP2015/066447 having an international filing date of Jun. 8, 2015, which claims priority to JP2014-129579 filed Jun. 24, 2014, the entire contents of which are incorporated herein by reference.

TECHNICAL FIELD

The present invention pertains to a shot processing apparatus and projector.

BACKGROUND ART

Shot processing apparatuses are known in which surface treatment is performed by projecting a projection material onto a workpiece. In one such known shot processing apparatus, projection material is projected toward a product from a centrifugal projector (see Patent Document 1, for example).

PRIOR ART REFERENCES

Patent Documents

Patent Document 1: Japanese Utility Model Unexamined Publication 59-116153

In this type of shot processing apparatus, the amount of projection material used is relatively large.

SUMMARY OF THE INVENTION

Problems the Invention Seeks to Resolve

The need therefore existed to reduce the amount of projection material used to effectively project projection material onto a workpiece.

With this need in mind, the present invention has the object of providing a shot processing apparatus and projector capable of limiting the amount of projection material used.

Means for Solving Problems

The present invention provides a shot processing apparatus comprising a centrifugal projector for projecting projection material onto a workpiece, and a support mechanism for supporting the workpiece at a processing position where the surface treatment can be performed by the projector;

wherein the projector comprises a control cage having a cylindrical shape, to the interior of which the projection material is supplied, and on the side wall of which an opening serving as a discharge port for the projection material is formed; and an impeller including multiple blades disposed so as to extend in a radially outward direction of the control cage on the outside of the control cage, and rotating about the central axis of the control cage, wherein a rearward inclining portion inclining toward rotationally rearward direction is formed on the rotationally forward surface of the blades.

According to this arrangement, a rearward inclining portion inclining in the rotational rearward direction of the impeller is formed on the surface of the impeller blades.

Therefore, projection material discharged later from the control cage opening contacts the blade surface and is accelerated toward the blade tip before projection material discharged earlier from the control cage opening contacts the blade surface.

This means that at the point in time when the first-discharged projection material contacts the blade surface, subsequently-discharged projection material and earlier-discharged projection material are collected at a position adjacent to the blade surface. Since projection material collected in a limited area on the blade surface is projected, the projection distribution can be concentrated, and wasted projection toward workpieces can be limited.

In another aspect of the invention:

the opening has a rectangular shape and two sides the opening are parallel to the cylinder axial center of the control cage.

According to this arrangement, projection material can be projected onto a workpiece in a concentrated manner.

In another aspect of the invention:

viewed in the direction of the rotational axis of the impeller, an angle formed by the projection position of projection material projected by the projector relative to opposite edges of the surface of a workpiece disposed in a processing position facing to the projector is within 30°;

and the rearward inclining portion inclines by 30° to 50° toward rotationally rearward direction relative to the radial direction of the impeller.

In another aspect of the invention:

the rearward inclining portion is formed on the base end portion of the blade;

and a rearward less-inclining portion with a smaller inclining angle toward the rotationally rearward direction than the rearward inclining portion is formed on the blade tip portion.

According to this arrangement, a rearward inclining portion is formed on the base end side of the blades, and a rearward less-inclining portion is formed on the tip portion side of the blade, therefore projection material concentrated by the rearward inclining portion can be accelerated and projected by the rearward less-inclining portion.

Note that the phrase "a smaller inclining angle to the rotationally rearward side than the rearward inclining portion" includes, in addition to cases where that inclining angle is smaller than the inclining angle toward rotationally rearward direction of the rearward inclining portion, configurations in which it extends radially, and in which it inclines to the rotationally forward direction.

In another aspect of the invention:

the impeller is attached to a rotary shaft of a drive motor via a hub.

According to this arrangement, the impeller is attached to a rotary shaft of a drive motor via a hub, therefore overall apparatus size can be reduced compared to the case in which it is connected to a drive motor through a belt.

In another aspect of the invention:

the radial length of the rearward inclining portion is set to be longer than the radial length of the rearward less-inclining portion.

According to this arrangement, projection material can be accelerated and projected by the rearward less-inclining portion after sufficiently being collected in the rearward inclining portion of the blade.

In another aspect of the invention:

a curved portion is provided for gradually connecting the rearward inclining portion and the rearward less-inclining portion.

According to this arrangement, after projection material is collected by the blade rearward inclining portion, the velocity of projection material is gradually increased and projection material is projected by the curved portion and the rearward less-inclining portion.

Another aspect of the invention:

further comprising a distributor disposed inside of the control cage and rotating in the same direction as the rotational direction of the impeller;

and wherein rotation of the distributor results in movement of projection material supplied to the inside of the control cage along the inner circumferential surface of the distributor in a gap between the distributor and the control cage, and the discharge direction of the projection material from the opening in the control cage inclines toward the rotationally forward direction of the impeller relative to the radial direction from the rotational center.

According to this arrangement, the discharge direction of projection material from the opening in the control cage inclines toward the rotational direction of the impeller relative to the radial direction from the rotational center, therefore the timing at which projection material first-discharged from the control cage opening contacts the blade surface can be delayed, and projection material can be concentrated at the rearward inclining portion of the blade surface.

In another aspect of the invention:

the surface of the blades on the rotationally rearward side of the impeller comprises, at its base end portion, a inclined portion inclining larger toward the rotationally rearward direction relative to the radial direction than the rearward inclining portion.

According to this arrangement, the amount of projection material directed to the adjacent blade can be limited when projection material discharged from the opening hits the base end portion of the blade reverse surface and bounces back. Disintegration of the flow of projection material between blades can thus be constrained.

Another aspect of the invention comprises:

a cabinet having a loading/unloading zone for loading/unloading workpieces at an internal upper position, and a processing zone for performing surface treatment on the workpiece using projection material projected from the projector at an internal lower position and a raising/lowering rotation mechanism constituting the support mechanism capable of raising and lowering the workpiece between the load/unload zone and the processing zone while supporting the workpiece, and of rotating about said raising/lowering direction.

According to this arrangement, the entire circumference of multiple workpieces can be treated by stacking the multiple workpieces and causing them to be supported by the raising/lowering rotation mechanism.

Another aspect of the invention comprises:

an inner lid capable of rising and falling between a first position located at upper side of the loading/unloading zone, and a second position located between the loading/unloading zone and the processing zone;

and an elevator mechanism for raising and lowering the inner lid so that the inner lid is disposed at the first position when the workpiece is loaded/unloaded from the loading/unloading zone, and the inner lid is disposed at the second position when the workpiece is placed in the processing zone.

According to this arrangement, leakage of the projection material into the loading/unloading zone side is blocked by the inner lid even if the projector projects projection material toward the workpiece side when the workpiece is disposed in the processing zone.

In another aspect of the invention:

wherein the raising/lowering rotation mechanism has a hold-down portion which is capable of extending through the inner lid, and holds down the workpiece from the above and is rotatable with said workpiece about the raising/lowering direction.

According to this arrangement, workpieces can be stably rotated around an axis along which the workpiece is raised and lowered, even when multiple workpieces are stacked.

Another aspect of the invention further comprises:

a workpiece inspection device provided on the sidewall side at the side of the loading/unloading zone; and wherein the workpiece inspection device is supported so as to be movable between a retracted position where workpiece inspection device can be laterally inserted between the workpiece and the inner lid/hold down portion when the inner lid and the hold down portion are separately placed in an upper direction of the apparatus from the workpiece supported by the raising/lowering rotation mechanism, and an inspection position located at a lateral position of the retracted position the position where the workpiece inspection device encompasses the side surface of the workpiece.

According to this arrangement, the status of side portion of the workpiece can thus be non-destructively inspected after projection material has been projected onto the material and before unloading the workpiece from the cabinet.

In another aspect of the invention:

the projector is disposed on the side wall of the cabinet laterally of the processing zone.

According to this arrangement, the height of the apparatus as a whole can be constrained even if the projection material supply portion etc. is disposed above the projector.

In another aspect of the invention:

the rotational direction of the impeller of the projector is set so that, viewed in the impeller rotational center line direction, the impeller blades move in the following order: the apparatus upper part direction, the processing zone direction, and the apparatus lower part direction.

This configuration can inhibit the leakage of projection material to the upper side.

Another aspect of the invention further comprises:

a circulation mechanism for circulating projection material projected by the projector back toward the projector;

wherein the circulation mechanism comprises:

a separator having an inlet at top portion thereof wherein dust is separated and removed from the projection material and dust supplied from the inlet, and projection material is discharged to the lower side thereof;

a shot tank adjacent to the inlet of the separator at its upper portion, having a shot supply port, wherein the projection material supplied to said shot supply port is stored for supply to the projector;

and a conveyor mechanism having: a first row conveyor for conveying projection material and dust from the lower portion to the upper portion and supplying projection material and dust to the separator inlet, and a second row conveyor, arranged in parallel with the first row conveyor, for conveying projection material discharged from the separator from the lower portion to the upper portion, and supplying the projection material to the shot supply port on the shot tank.

According to this arrangement, a shot tank shot supply port is provided adjacent to the separator inlet, and no separator is disposed on the upper side of the shot tank, therefore the height of the apparatus can be constrained.

In another aspect of the invention:

the conveyor mechanism comprises a bucket elevator having:

a shared motor for driving the first row conveyor and the second row conveyor;

a single endless belt rotationally driven by the motor;

multiple first buckets attached to the endless belt and constituting the first row conveyor;

and multiple second buckets attached to the endless belt juxtaposed with the first buckets and constituting the second row conveyor.

According to this arrangement, a common or shared motor and a single endless belt are used, therefore the number of parts can be reduced, and the apparatus can be made compact.

Another aspect of the invention further comprises:

a partitioning portion close to the lower portion of the endless belt, for partitioning between the first row conveyor and the second row conveyor.

According to this arrangement, the mixed material (projection material and dust) before dust is separated and removed by the separator, is prevented from mixing with the projection material from which dust had been separated and removed by the separator.

Another form of the invention provides:

a centrifugal projector for projecting projection material onto a workpiece, comprising:

a control cage having a cylindrical shape wherein projection material is supplied to the interior thereof, having an opening formed as a projection material discharge portion on the outer circumferential wall thereof, and the opening having a rectangular shape including two sides parallel to the axial center of the cylindrical shape and an impeller having multiple blades disposed at positions in the radially outward position of the control cage, and rotating in a circumferential direction of the control cage, on which a rearward inclining portion inclining to the rearward side in the direction of rotation, is disposed on the rotationally forward surface of the blade.

In another aspect of the invention, viewed in a direction of the impeller rotational axis, the angle formed by the projection position of projection material projected by the projector relative to the two opposite edges of the surface of a workpiece disposed in a processing position facing the projector is within 30° and the rearward inclining portion inclines by 30° to 50° toward rotationally rearward direction relative to radial direction of the impeller.

Another form of the invention provides:

A centrifugal projector installed on a shot processing apparatus and projecting projection material by the rotation of an impeller;

intended for surface treatment of a workpiece, such that when viewed in the direction of the rotational axis of the impeller, the angle formed between the position at which projection material is projected by the projector and two opposite edges of the surface of a workpiece disposed in a processing position facing the projector is within 50° to 80°;

the centrifugal projector comprising: a control cage having a cylindrical shape, wherein projection material is supplied to the interior thereof, and an opening is formed as a projection material discharge portion on the outer circumferential wall, and the opening has a rectangular shape including two opposite sides parallel to the axial center of the cylindrical shape;

and an impeller comprising multiple blades disposed at positions in the radial outward direction of the control cage, and rotating in the control cage circumferential direction, on which a rearward inclining portion inclining toward rotationally rearward direction, is disposed on the rotationally forward surface of the blade;

wherein the opening comprises:

a first opening portion having a rectangular shape including two sides parallel to the central axis of the control cage;

and a second opening portion having a rectangular shape including two parallel sides, parallel to the control cage axial center and opposing one another, and offset from the circumferential direction of the control cage relative to the first opening portion;

wherein the first opening portion and the second opening portion are approximately half overlapped in the direction of the cylinder axial center of the control cage.

According to this arrangement, projection material discharged later from the control cage opening contacts the blade surface and is accelerated toward the blade tip end before projection material discharged earlier from the control cage opening contacts the blade surface. This means that at the point in time when the first-discharged projection material contacts the blade surface, subsequently-discharged projection material and earlier-discharged projection material are collected at a limited area on the blade surface. Projection material can in this way be projected in a concentrated manner.

In addition, projection material respectively discharged from the first opening portion and the second opening portion are discharged from offset positions in the circumferential direction of the control cage, therefore the projection distribution as a whole is the combination of the projection distribution of projection material discharged from the first opening portion and the projection distribution of projection material discharged from the second opening portion.

Here, approximately half of the first opening portion and the second opening portion overlap in the control cage cylinder axis center direction, so the respective projection distributions of projection material discharged from the first opening portion and the second opening portion also overlap in approximately half the respective distribution widths. Thus as an overall projection distribution, the range over which the projection fraction is high (the range in which a concentrated projection was sought) is broadened.

Effect of the Invention

The present invention provides a shot processing apparatus and projector with which the amount of projected projection material can be constrained.

DETAILED DESCRIPTION OF THE PREFERRED EMBODIMENTS

First Embodiment

Referring to FIGS. 1 through 23, a shot blasting apparatus 10 according to a first embodiment of the shot processing apparatus of the invention will be explained. Note that in the diagram, the FR arrow indicates the front side of the apparatus as viewed from the front; the UP arrow indicates the upper side of the apparatus, and the LH arrow indicates the left side when the apparatus is viewed from the front.

Figure 1:
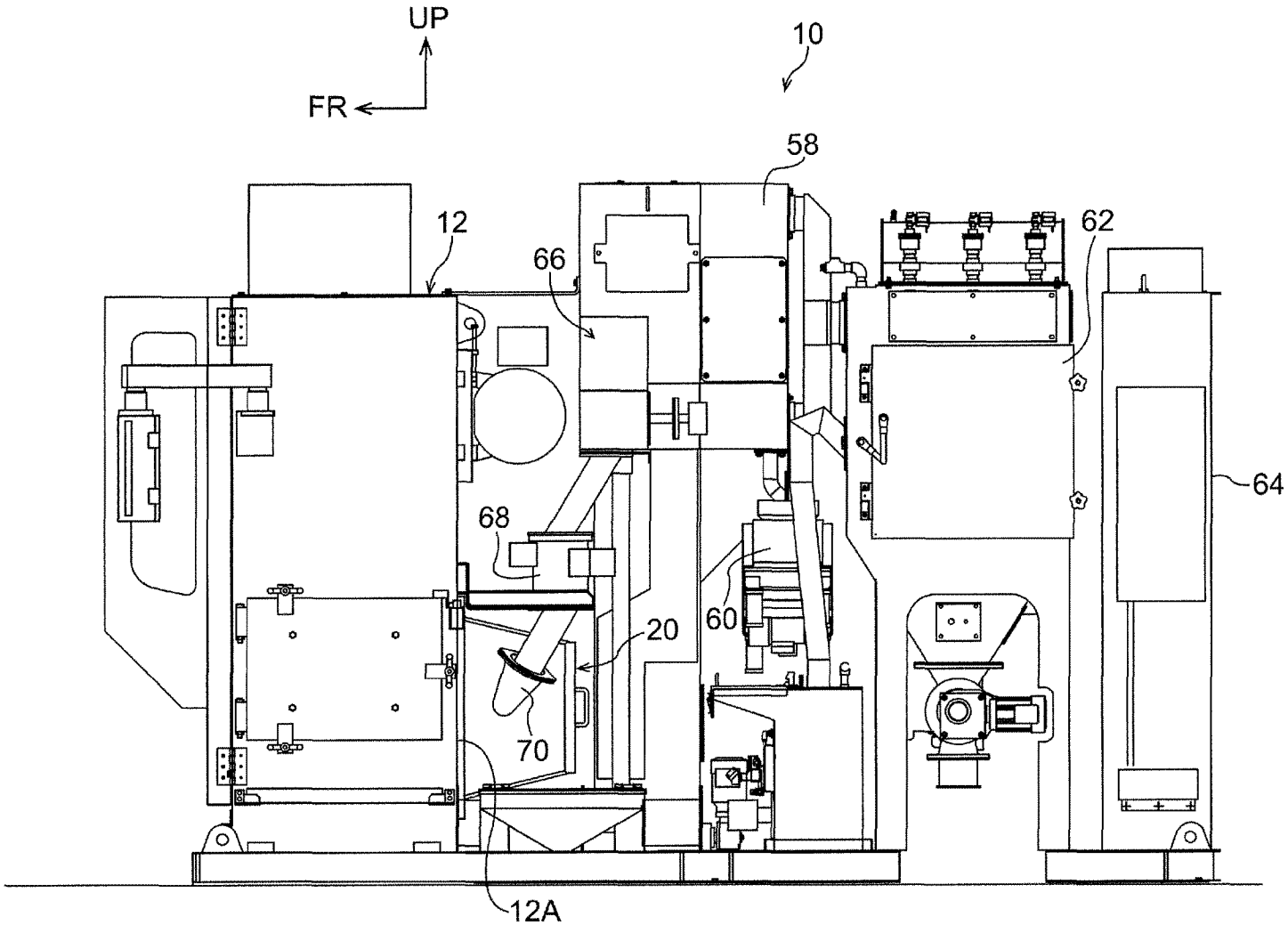
FIG. 1 is a right side elevational view of a shot blasting apparatus according to a first embodiment of the invention.
Figure 2:
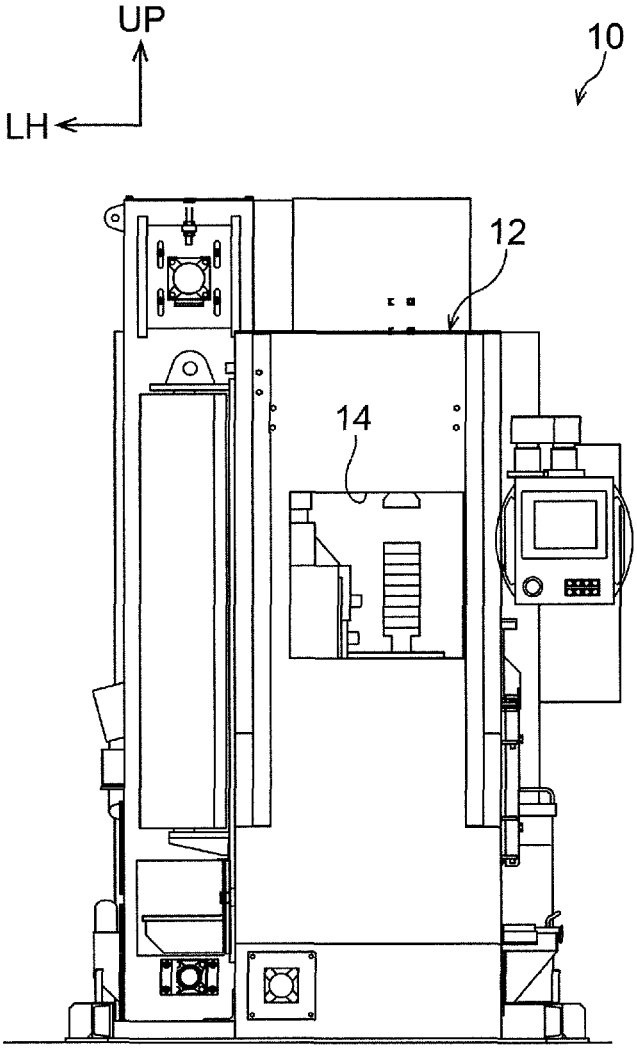
FIG. 2 is a front elevational view of the shot blasting apparatus shown in FIG. 1.

FIG. 1 is a right side elevation of a shot blasting apparatus 10; FIG. 2 is a front elevational view of the shot blasting apparatus 10. As shown in FIG. 1, the shot blasting apparatus 10 comprises a cabinet 12 formed in a box shape. As shown in FIG. 2, a loading/unloading port 14 is formed in an top portion on the front side of the cabinet 12.

Figure 5B:
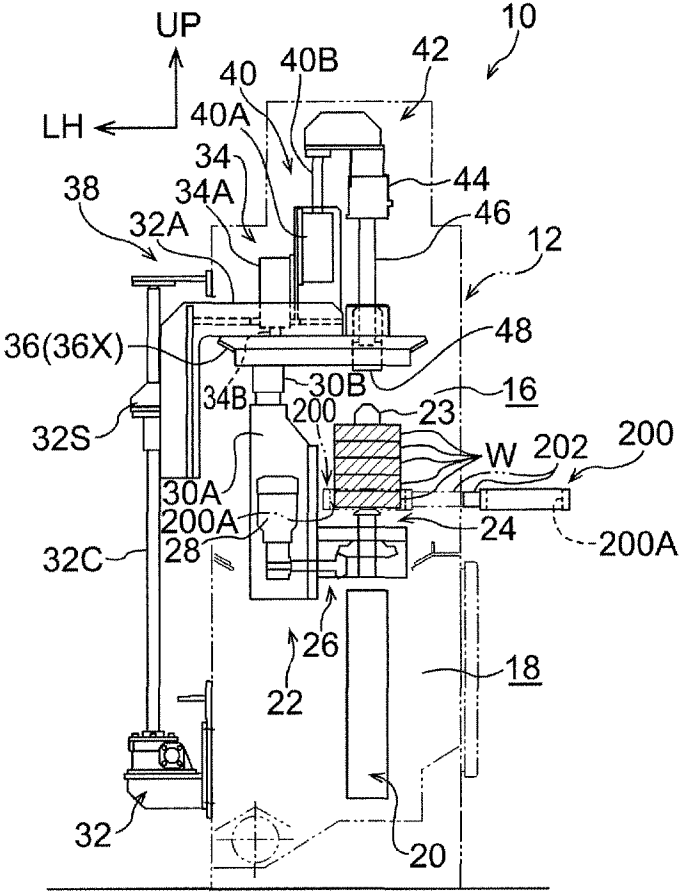
FIG. 5: (A) is a left side elevational view showing a part of the shot blasting apparatus shown in FIG. 1; (B) is a schematic diagram, viewed from the apparatus front, showing the interior of the cabinet of the shot blasting apparatus shown in FIG. 1.

FIG. 5B is a schematic of the interior of the cabinet 12 in the shot blasting apparatus 10, viewed from the front side of the apparatus.

The upper portion of the internal space in the cabinet 12 shown in FIG. 5B is a loading/unloading zone 16 from which workpieces W are loaded and unloaded. In contrast to this, the bottom portion of the internal space in the cabinet 12 is a processing zone 18 where surface treatment is performed on the workpiece W.

Figure 5A:
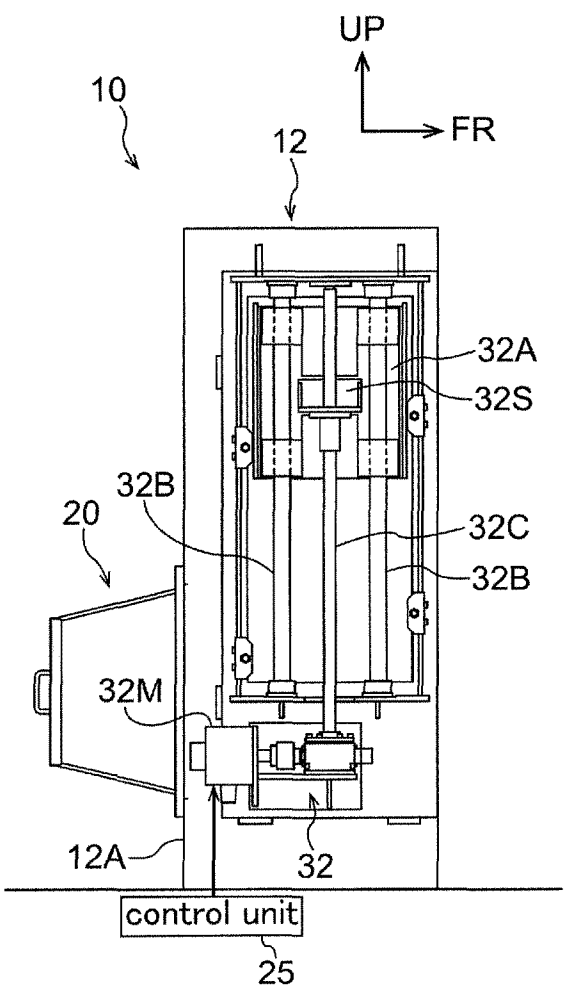

FIG. 5A is a left side elevational view of a part of the shot blasting apparatus 10, including the cabinet 12.

As shown in FIG. 5, a centrifugal projector 20 is installed on the side wall portion 12A of the cabinet 12 at the side of the processing zone 18 (FIG. 5B). The centrifugal projector 20 is able to project projection material onto the workpiece W shown in FIG. 5B (see FIG. 23), and surface treatment of the workpiece W is performed using projection material projected from the centrifugal projector 20. Details of the centrifugal projector 20 will be explained below.

A raising/lowering rotation mechanism 22 is disposed in the cabinet 12. The raising/lowering rotation mechanism 22 constitutes a support mechanism for supporting the workpiece W at a processing position (FIGS. 22 and 23) at which surface treatment by the centrifugal projector 20 can be performed, and is configured to support the workpiece W and to raises and lowers the workpiece W between the loading/unloading zone 16 and the processing zone 18, and is capable of rotating the workpiece W about an vertical axis.

The raising/lowering rotation mechanism 22 comprises a work receiving portion 24 for receiving workpiece W. In the present embodiment, the workpiece W is constituted by multiple stacked gears (e.g., 5 gears). A shaft (not shown) extending through the center hole of these gears, and a cap 23 is fitted onto the top end portion of the shaft. The bottom end surface of the cap 23 contacts the top surface of the upper-most gear. With the cap 23 held down so as to rotate about a vertical axis, the cap 23 and the workpiece W are able to rotate as an integral unit about the vertical axis. The work receiving portion 24 is connected through a drive force transmission mechanism 26 to a motor 28, and by operation of the motor 28 is able to rotate about a vertical axis.

The motor 28 is fixed to a motor holding portion 30A, and an L-shaped bracket 32A is coupled through coupling portion 30B to the top end portion of the motor holding portion 30A. As shown in FIG. 5A, the bracket 32A is able to rise and fall along a pair of guide shafts 32B extending in a vertical direction. An elevator member 32S is fixed at the apparatus left side of the bracket 32A (front side in FIG. 5A). The elevator member 32S threadedly engages a ball screw 32C extending in a vertical direction of the apparatus, between the pair of guide shafts 32B. The ball screw 32C is connected to an elevator servo motor 32M. Rotation of the elevator servo motor 32M can be converted to a vertical linear motion, that is, the elevator member 32S can be made to rise and fall in response to forward and reverse rotation of the elevator servo motor 32M.

Thus the elevator servo motor 32M, the ball screw 32C, the elevator member 32S, the bracket 32A, and the guide shafts 32B constitute a jack 32 for raising and lowering. The elevator servo motor 32M is connected to a control unit 25, and operation is controlled by the control unit 25. In other words, the control unit 25 controls the forward rotation, reverse rotation, and stopping of the elevator servo motor 32M in response to the instruction from an operator.

As shown in FIG. 5B, a cylinder 34A in a first cylinder mechanism 34 is fixed to the bracket 32A. In the first cylinder mechanism 34, the top portion of a rod 34B and a piston (not shown), are disposed within the cylinder 34A. The rod 34B is fixed to a piston at its top end portion, and the bottom end part thereof extends below the cylinder 34A. The piston and the rod 34B are able to move (reciprocally move in an up and down direction) relative to the cylinder 34A under the fluid pressure (air pressure in this embodiment) inside the cylinder 34A.

An inner lid 36 is fixed at the bottom end portion of the rod 34B. By the operation of the jack 32 and the first cylinder mechanism 34, the inner lid 36 is able to move up and down between a first position 36X, which is a position of the top end side of the loading/unloading zone 16 (the position shown in FIG. 5B), and a second position 36Y (FIG. 22), which is the position between the loading/unloading zone 16 and the processing zone 18. I.e., the elevator mechanism 38 for raising and lowering the inner lid 36 is constituted so that coordinated action of the jack 32 and the first cylinder mechanism 34 results in the placement of the inner lid 36 at the first position 36X when a workpiece W is loaded/unloaded to/from the loading/unloading zone 16, and so that the inner lid 36 is placed in a second position 36Y (FIG. 22) when the workpiece W is placed in the processing zone 18.

There is also a second cylinder mechanism 40 cylinder 40A fixed to the bracket 32A. In the second cylinder mechanism 40, the lower portion of a rod 40B and a piston (not shown) are disposed inside the cylinder 40A. The rod 40B is fixed to the piston at its bottom end portion, and the top portion side extends above the cylinder 40A. The piston and the rod 40B are able to move (move reciprocally in an up and down direction) relative to the cylinder 40A under the fluid pressure (air pressure in this embodiment) inside the cylinder 40A.

The top end portion of rod 40B is coupled to a bearing 44 through a coupling portion 42. The bearing 44 is disposed at the right side of the second cylinder mechanism 40 in the apparatus. The top end portion of a vertically extending hold-down shaft 46 is pressed into this bearing 44. The hold-down shaft 46 is rendered incapable of vertical movement relative to the bearing 44, but is able to rotate about the hold-down shaft 46 relative to the bearing 44. A hold-down portion 48 is attached to the bottom end portion of the hold-down shaft 46. The hold-down portion 48 is able to rotate about a vertical axis together with the hold-down shaft 46, and is able to extending in a through hole in the inner lid 36. The hold-down portion 48 is able to hold down a workpiece W loaded onto a work receiving portion 24 through a cap 23, and with the workpiece W held down, is able to rotate about an axis extending in the vertical direction (the raising/lowering direction) together with the workpiece W.

Note that the cylinder 34A of the first cylinder mechanism 34 and the cylinder 40A of the second cylinder mechanism 40 are respectively connected through an air direction control device such as a solenoid valve (not shown) to an air supply source, and the air direction control device is connected to the control unit 25. The control unit 25, by controlling each air direction control device in response to the instruction from the operator, enables the control of the rods 34B and 40B in the advancing and retracting directions.

In the cabinet 12, a workpiece inspection apparatus 200 is provided on the side wall portion of the loading/unloading zone 16. The workpiece inspection apparatus 200 has a cylindrical shape, such as a short cylinder shape; and is disposed so that the extending direction thereof is the up/down direction, and is housed in a housing (not shown). The housing and the workpiece inspection apparatus 200 are omitted in FIG. 1 and others drawings where appropriate.

As shown in FIG. 5B, the workpiece inspection apparatus 200, by being disposed to surround the side surface of a workpiece W supported by the raising/lowering rotation mechanism 22, i.e., by being disposed so that an inner circumferential surface 200A of the workpiece inspection apparatus 200 and side surface of the workpiece W face one another, is able to non-destructively inspect the state of the side portion of the workpiece W (e.g., residual stress, surface roughness, hardness, etc.). In the present embodiment the workpiece inspection apparatus 200 is a non-destructive inspection apparatus, and non-destructively can inspect the state of the side portion of the workpiece W using voltage variations caused by electrical eddy currents. The workpiece inspection apparatus may also be a contact-type inspection apparatus.

The workpiece inspection apparatus 200 is fixed to the tip portion of a rotary arm 202. The base end portion of the rotary arm 202 is disposed on the cabinet 12 side, and is able to rotationally move about a vertical axis. The workpiece inspection apparatus 200, by being fixed to the tip portion of the rotary arm 202, is movably supported between the retracted position shown by the solid line, and the inspection position shown by the double dot and dash line.

Here the retracted position of the workpiece inspection apparatus 200 is a position at which the workpiece inspection apparatus 200 can be inserted from the side direction between the workpiece W and the inner lid 36 and hold-down portion 48 when the inner lid 36 and hold-down portion 48 are disposed at a distance from a workpiece W, supported by the raising/lowering rotation mechanism 22.

In the present embodiment, when the workpiece W and the inner lid 36 and hold-down portion 48 are lowered by the activation of the jack 32 from the state shown in FIG. 5B without changing the relative positions of the workpiece W and the inner lid 36 and hold-down portion 48, the workpiece inspection apparatus 200 can be inserted between the workpiece W and the inner lid 36 and hold-down portion 48 from the side.

In addition, the retracted position of the workpiece inspection apparatus 200 is set to a position at which raised or lowered other members and the workpiece inspection apparatus 200 do not interfere with one another when the workpiece W is raised or lowered by the raising/lowering rotation mechanism 22, or when the inner lid 36 is raised and lowered by an elevator mechanism 38.

In contrast, the inspection position of the workpiece inspection apparatus 200 is lateral of the retracted position, and becomes the position at which the side surface of the workpiece W is surrounded when it has been raised or lowered by the raising/lowering rotation mechanism 22. I.e., when the raising/lowering rotation mechanism 22 raises and lowers the workpiece W, the inspection position of the workpiece inspection apparatus 200 is located outside of the moving path of the side surface of the workpiece W.

The rotary arm 202 is connected to a motor (not shown), and moves rotationally, driven by a motor. The motor is connected to a control unit 25 (FIG. 5A). The control unit 25 can control operations of the motor, such as motor forward and reverse rotations, stopping and so forth, in response to the instructional from the operator.

Figure 6:
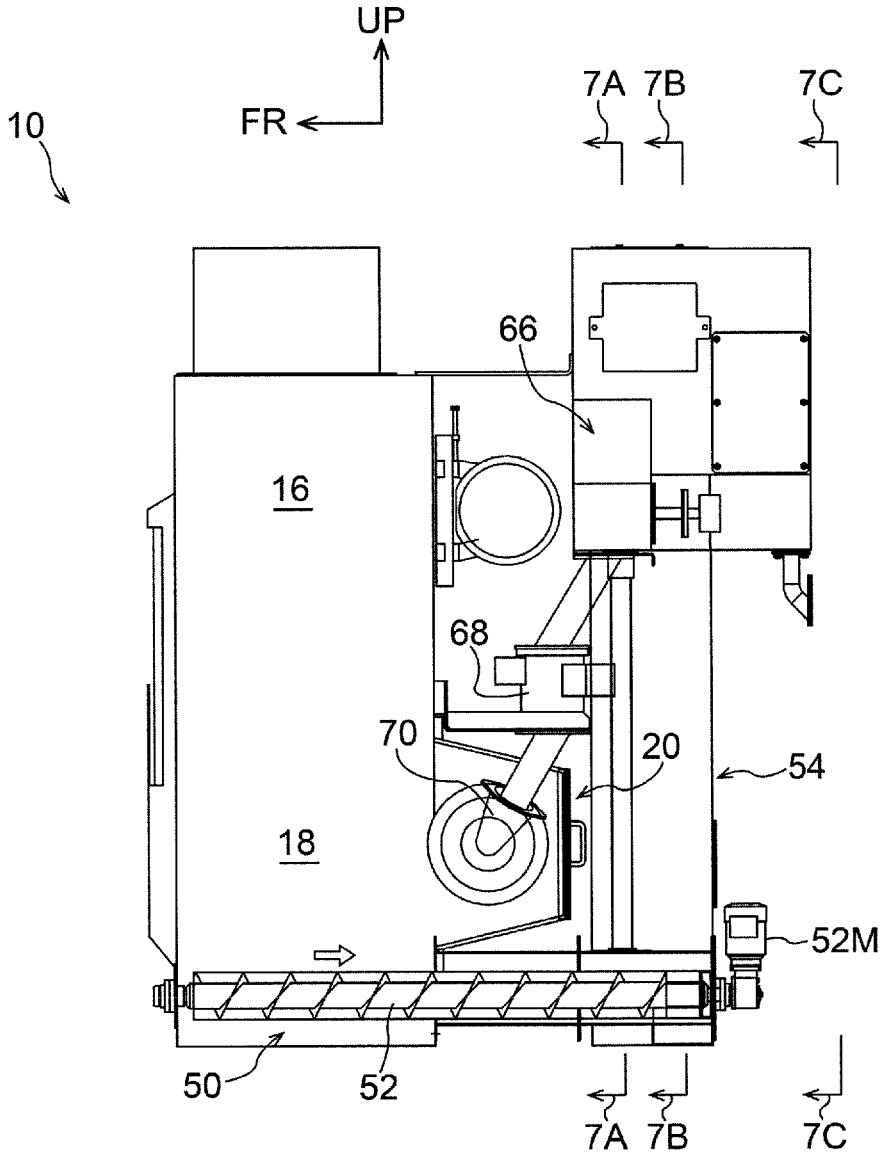
FIG. 6: is a right side elevational view showing the circulation mechanism in the shot blasting apparatus shown in FIG. 1.

FIG. 6 is a side elevational view in which a circulation mechanism 50 on the interior of the shot blasting apparatus 10 is viewed from the right side. The circulation mechanism 50 is a mechanism for circulating projection material projected by the centrifugal projector 20. As shown in FIG. 6, a screw conveyor 52 is provided at the bottom portion of the processing zone 18. The screw conveyor 52 is disposed horizontally, to extend in the front-to-back direction of the apparatus, and is connected to a motor 52M placed at the rear portion in the apparatus. The screw conveyor 52 rotates about a longitudinal axis, activated by motor 52M, and projection material which has dropped from the processing zone 18 is conveyed to the rear portion in the apparatus in the longitudinal direction of the screw conveyor 52.

The bottom end portion of a bucket elevator 54 is disposed on the downstream side of the screw conveyor 52 as a vertically extending conveyor mechanism. The bucket elevator 54 is an apparatus for conveying projection material and the like supplied from the screw conveyor 52 to the top portion of the apparatus. The arrangement of the bucket elevator 54 is described elsewhere below.

Figure 7C:
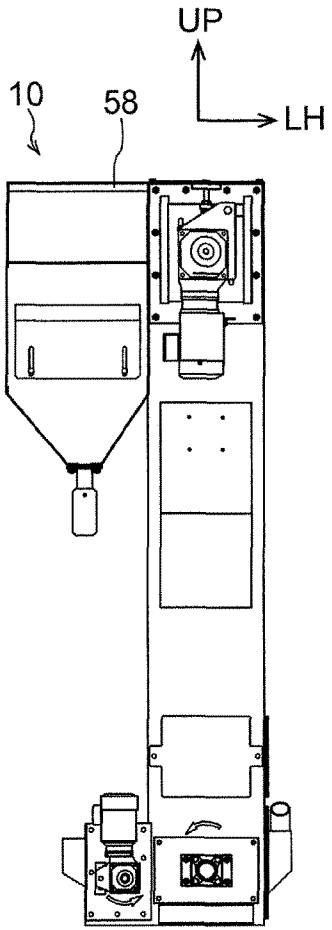
FIG. 7: (A) is a cross sectional view taken along line 7A-7A in FIG. 6; (B) is a cross sectional view taken along line 7B-7B in FIG. 6; (C) is a cross sectional view taken along line 7C-7C in FIG. 6.
Figure 7B:
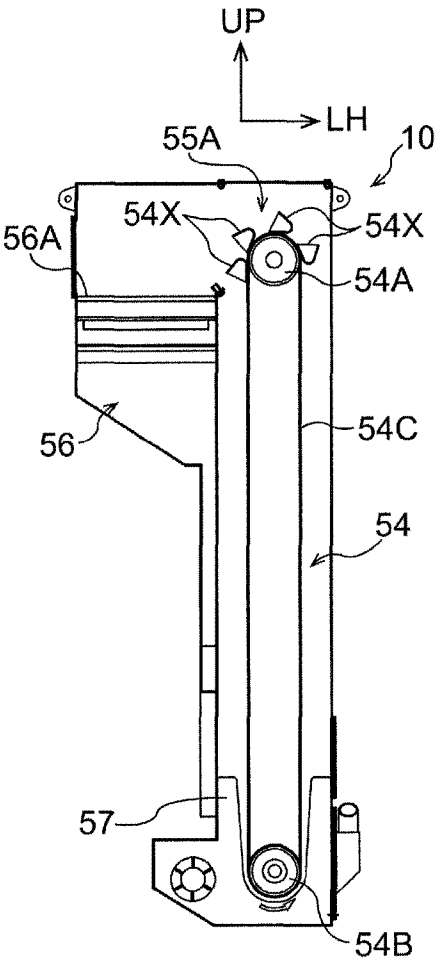
Figure 7A:
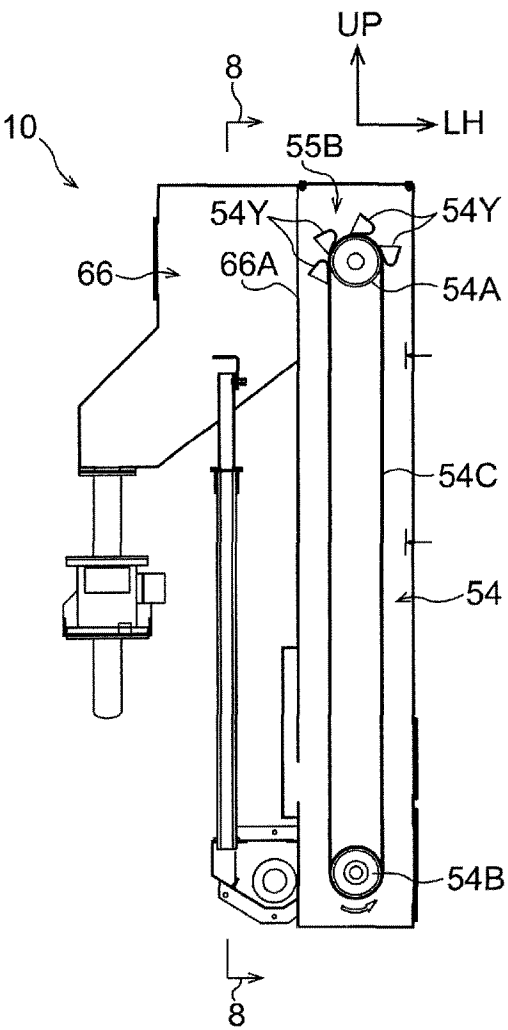
Figure 8:
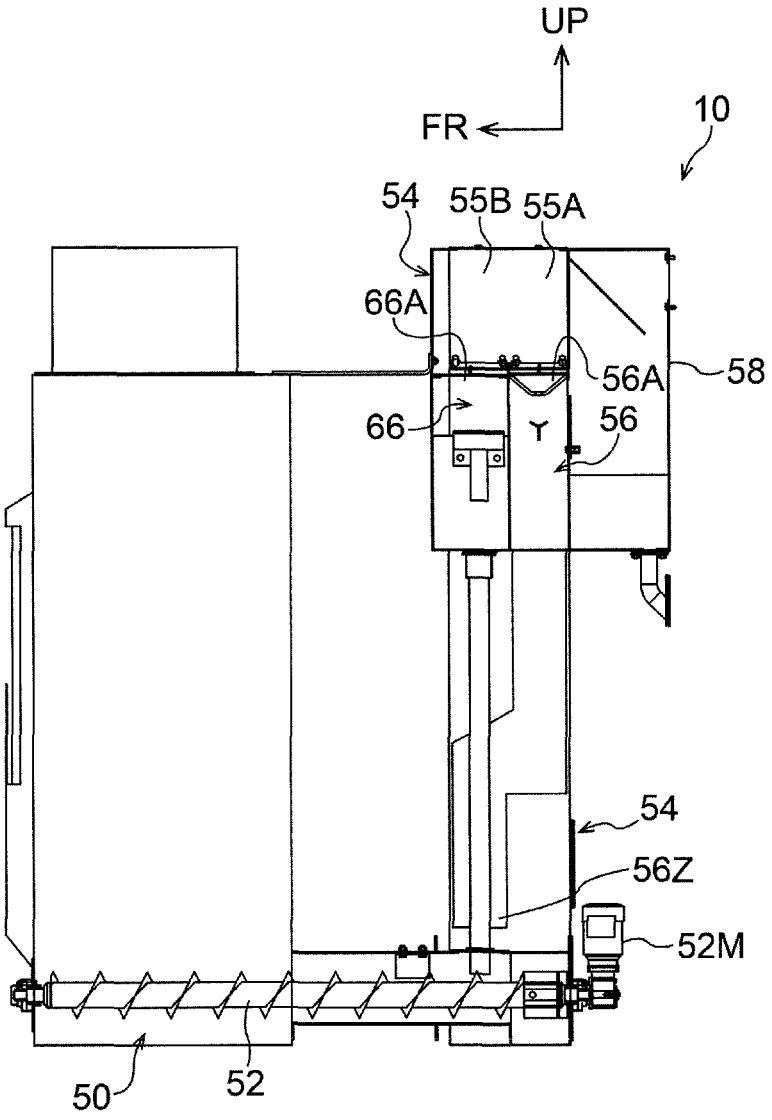
FIG. 8: is a cross sectional view taken along line 8-8 in FIG. 7(A).

FIG. 7A is a cross sectional view along line 7A-7A in FIG. 6; FIG. 7B is a cross sectional view along line 7B-7B in FIG. 6; FIG. 7C is a cross sectional view along line 7C-7C in FIG. 6. FIG. 8 is a cross sectional view along line 8-8 in FIG. 7A.

As shown in FIG. 7B and FIG. 8, an inlet 56A of a separator 56 is provided on an upper portion in the shot blasting apparatus 10, facing to a rear side (the right side in FIG. 8) of the top portion of the bucket elevator 54. In the present embodiment, the separator 56 is a winnowing separator which applies an air current to projection material and dust ejected from the bucket elevator 54 and supplied from inlet 56A, and winnows out lightweight objects carried by the air current from heavyweight objects, which drop. After separating and removing dust from the mixture of projection material and dust, the separator 56 ejects suitable projection material to the underside of the apparatus. As shown in FIG. 8, the discharge position 56Z for projection material separated by the separator 56 is provided at front position in the apparatus (left side in FIG. 8) at the bottom end portion of the bucket elevator 54.

Figure 3:
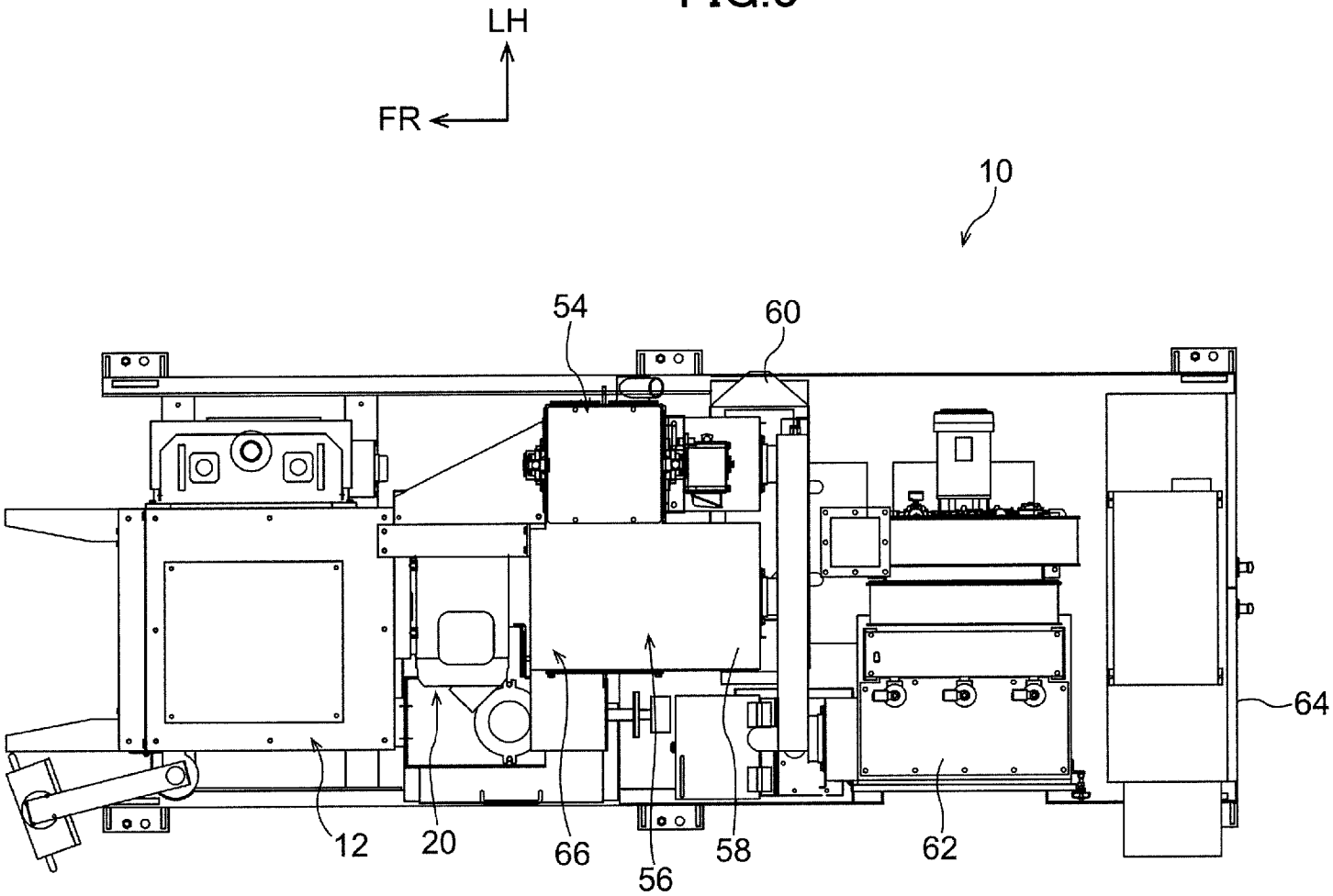
FIG. 3 is a plan view of the shot blasting apparatus shown in FIG. 1.
Figure 4:
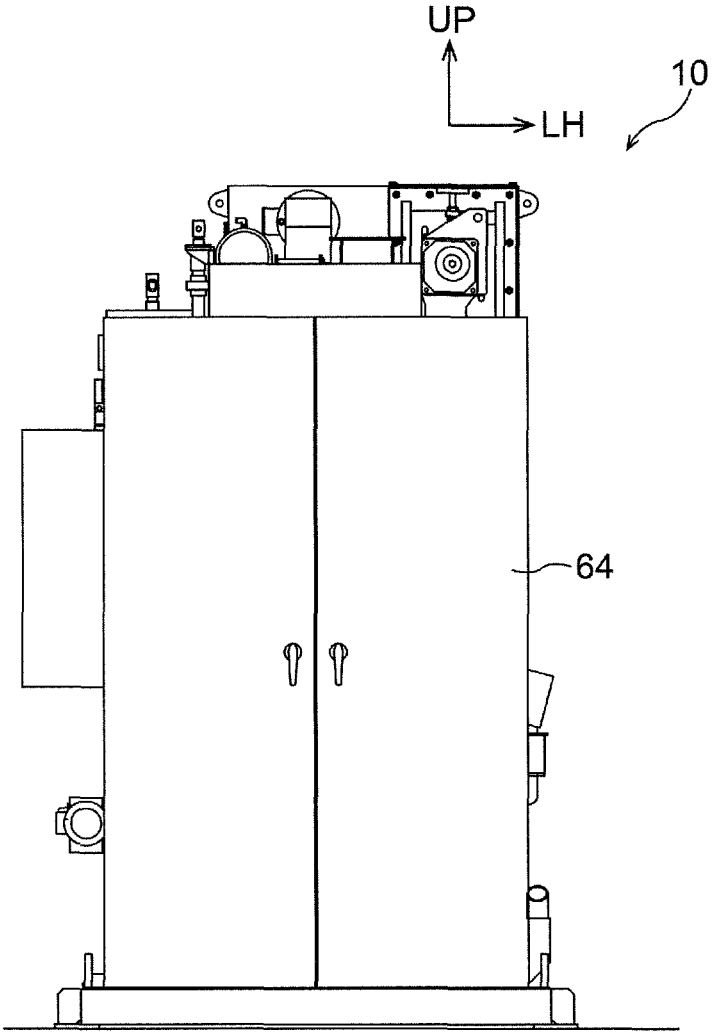
FIG. 4 is a rear elevational view of the shot blasting apparatus shown in FIG. 1.

A settling chamber 58 is placed on rear side relative to the projection portion of the upper portion bucket elevator 54 in the apparatus. FIG. 3 shows a plan view of the shot blasting apparatus 10. As shown in FIG. 3, a screen portion 60 and dust collector 62 are connected to the settling chamber 58. As shown in FIG. 3 and FIG. 4, which is a rear elevational view of the shot blasting apparatus 10, a control panel 64 is disposed on the rear position of the dust collector 62 in the apparatus.

The settling chamber 58 shown in FIG. 3 separates the dust contained in the mixture which includes projection material projected from the top portion of the bucket elevator 54 into fine grain and coarse grain. Separated fine grain is suctioned into the dust collector 62 together with air, and coarse grain flows to the screen portion 60. The dust collector 62 filters air containing fine dust and exhausts only air to the atmosphere. The screen portion 60 screens course grain, and the screening returns usable projection material to a position on the front position of the bottom end portion of the bucket elevator 54 in the apparatus.

As shown in FIGS. 7A and 8, a shot supply port 66A for a shot tank 66 is placed at the top end portion of the shot blasting apparatus 10, adjacent to the separator 56 inlet 56A. The shot supply port 66A is disposed at a position corresponding to the apparatus front side of the top portion of the bucket elevator 54 (FIG. 8 left side). The shot tank 66 holds projection material supplied to the shot supply port 66A as projection material supplied to the projector 20 (FIG. 6). As shown in FIG. 6, the shot tank 66 is connected through a flow quantity adjustment device 68 and an introducing tube 70 to the projector 20. Note that the flow quantity adjustment device 68 is a device for adjusting the flow quantity of projection material, comprising a shot gate (not shown) capable of opening and closing the projection material supply opening.

Figure 9:
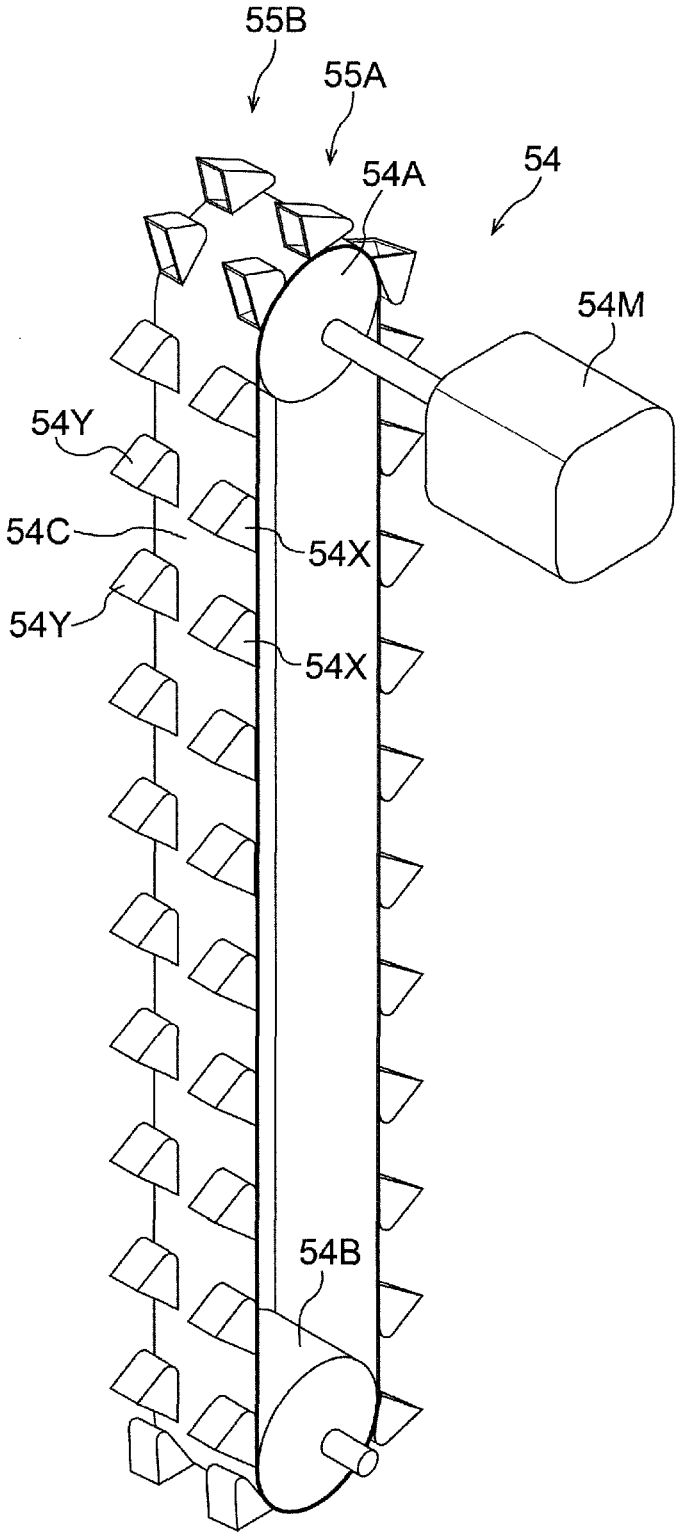
FIG. 9: is a schematic perspective view schematically showing the arrangement of a bucket elevator.

Next, the bucket elevator 54 will be explained. FIG. 9 is a perspective view schematically showing the arrangement of the bucket elevator 54.

As shown in FIGS. 7A, 7B, and 9, the bucket elevator 54 comprises pulleys 54A and 54B disposed at the top and bottom position in the shot blasting apparatus 10; the top side pulley 54A is connected to a drive motor 54M (FIG. 9) and can be rotationally driven. A single endless belt 54C is wound around a pair of an upper pulley 54A and a lower pulley 54B, and the endless belt 54C rotates through the pulley 54A by means of the motor 54M.

As shown in FIG. 9, multiple first buckets 54X, disposed in a line at a fixed interval in a longitudinal direction of the endless belt 54C, are attached at one edge in the width direction of the endless belt 54C. Also, multiple first buckets 54Y, disposed in a line, parallel to the first buckets 54X, at a fixed interval in the longitudinal direction of the endless belt 54C, are attached at the other edge in the width direction of the endless belt 54C.

As shown in FIG. 7B, a first row conveyor 55A, constituted by multiple first buckets 54X, serves as a conveyor portion for conveying projection material and dust from the bottom portion to top portion of the apparatus, supplying the projection material to the inlet 56A of the separator 56. As shown in FIG. 7A, a second row conveyor 55B, formed by multiple second buckets MY, conveys projection material discharged from the separator 56 from the bottom portion to the top portion of the apparatus, supplying the projection material to the shot supply port 66A on the shot tank 66. Then, as shown in FIG. 9, the first row conveyor 55A and the second row conveyor 55B are commonly driven by the motor 54M.

As shown in FIG. 7B, a partitioning portion 57 is provided close to the bottom portion of the endless belt 54C. A first row conveyor 55A and a second row conveyor 55B (FIG. 7A) is divided by this partitioning portion 57.

Projector Configuration

Next, referring to FIGS. 10 through 20, details of the projector 20 will be explained.

The projector 20 is a centrifugal projector for projecting projection material onto a small workpiece W (as an example, gear approximately 100 mm to 200 mm diameter and 45 to 50 mm high, stacked to a height of 250 mm).

In the projector 20 of the present embodiment, viewed from the direction of rotation of the impeller 100, the spread (projection angle) of projected projection material is about 30°. In the shot blasting apparatus 10 of the present embodiment, using the position of projection of projection material by the projector 20 as the highest point, the dimensions, position, etc. of the workpiece W are selected so that the angle (center angle) at the peak point, when both edges are joined on the surface facing the projector 20 of a workpiece W disposed in the processing position, is within 30°, and so that the treated surface of the workpiece W is fully processed by the projection material from the projector 20.

A small workpiece W used in the shot blasting apparatus 10 of the present embodiment is of a size equal to a workpiece processed by an air-type jetting apparatus, which is an apparatus for jetting compressed air containing projection material from a nozzle.

Figure 10:
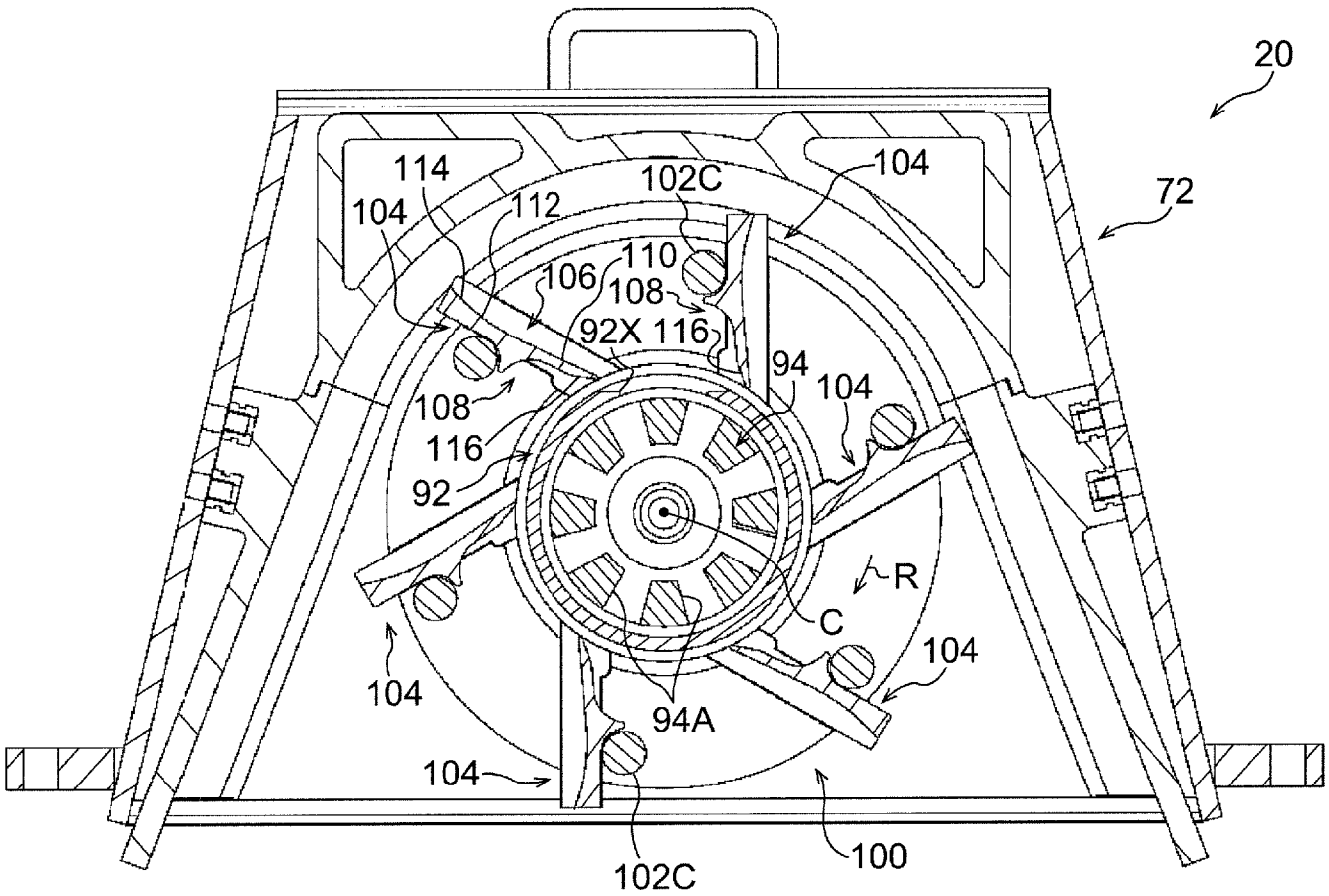
FIG. 10: is a cross sectional view, viewed from front, showing the projector of the shot blasting apparatus of a first embodiment.
Figure 11:
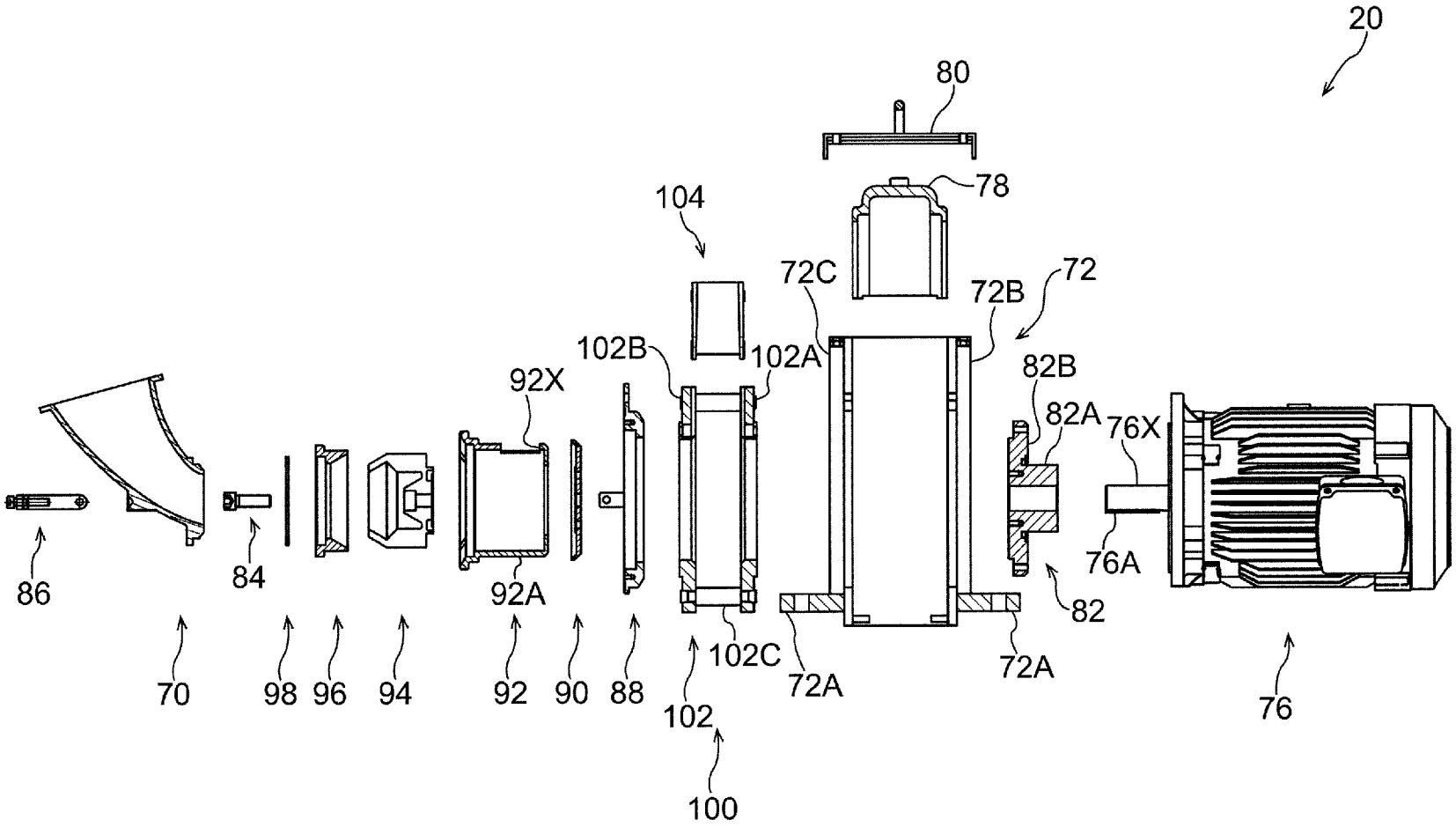
FIG. 11: is an exploded side elevational view of the projector shown in FIG. 10.

FIG. 10 is a front elevational view of the projector 20; FIG. 11 is an exploded side elevational view of the projector 20.

Figure 24:
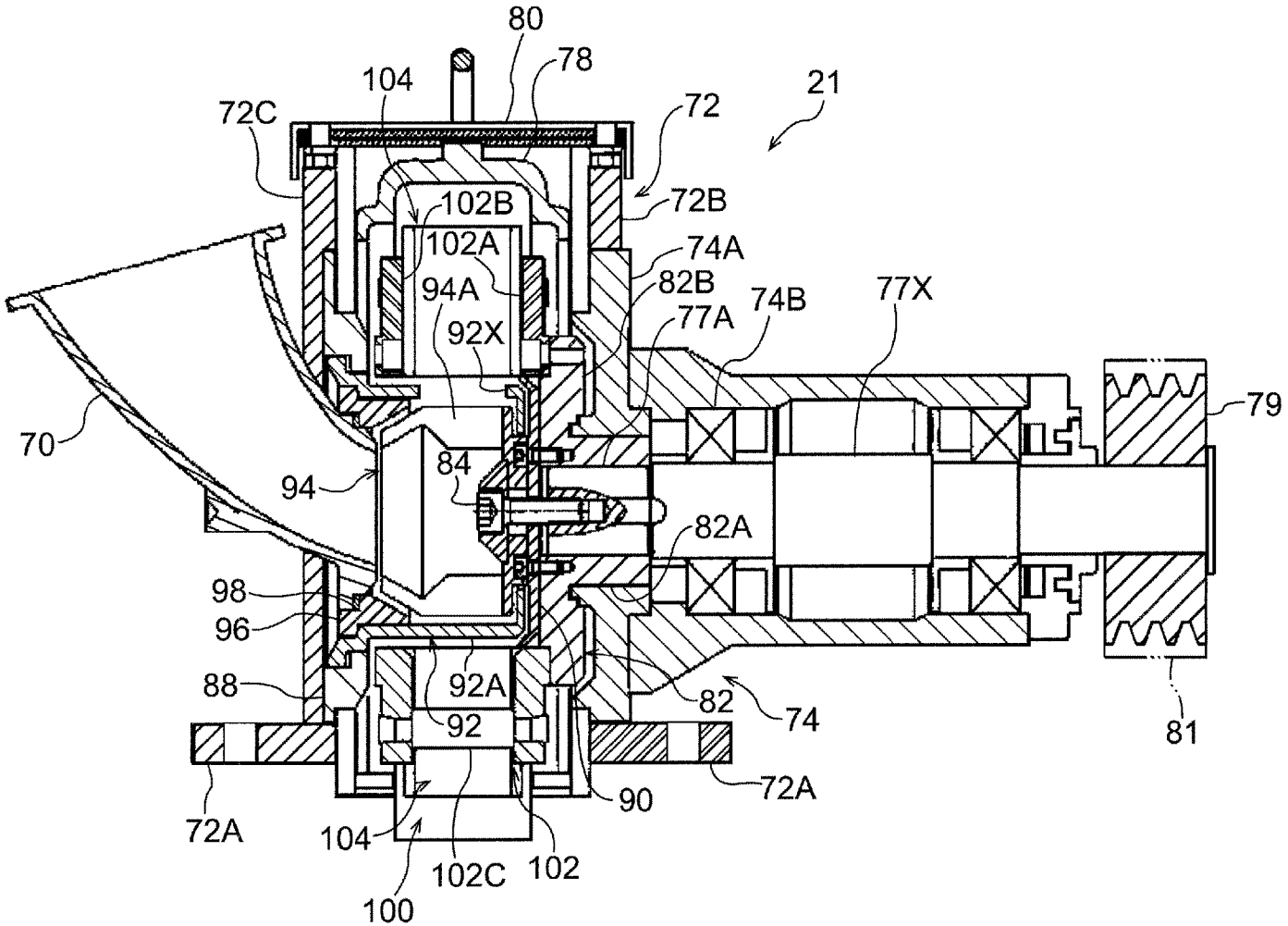
FIG. 24: is a vertical cross sectional view, viewed from the side, of a projector according to an alternative example.

Note that the vertical cross section of the projector 20 viewed from lateral direction is the same as the vertical cross section shown in FIG. 24 showing a projector 21 of a second embodiment, described below, except for the part in which the drive motor 76 is assembled. Hence even in the explanation of the present embodiment, FIG. 24 will be referenced, as appropriate.

As shown in FIGS. 10 and 11, the projector 40 comprises a case main unit 72. The case main unit 72 is formed so that its outside shape is approximately a truncated pyramid, the bottom portion (bottom side in FIG. 10) of which is open, and serves as a projection portion for the projection material. As shown in FIG. 10, from the bottom portion of a case main unit 72, bases 72A are extended in a mutually separating direction, and fixed to the side wall portion 12A of the cabinet 12 (FIG. 1).

A through hole into which the hub 82 and the like are inserted, is formed on the side portion 72B on one side of the case main unit 72. Also, a through hole into which the introducing tube 70 is inserted is formed on the side portion 72C on the other side of the case main unit 72. Further, a cover 80 is attached at the top of the case main unit 72, and a through hole is formed in the cover 80 into which hole the upper part of a liner 78 is inserted. The liner 78 is attached to the inside of the case main unit 72.

A control cage 92 is disposed at center position in the case main unit 72. The control cage 92 is attached to a side portion 72C of the case main unit 72 through a front surface cover 88. The control cage 92 has a cylindrical shape and is disposed concentrically with the shaft 76X of the drive motor 76, so that projection material is supplied from the introducing tube 70 to the interior. A ring-shaped bracket 96 and a seal member 98 are disposed between the inner circumferential portion of the control cage 92 and the end portion of the introducing tube 70. Note that part of the introducing tube 70 is held down by an introducing tube hold-down 86 (FIG. 11).

Figure 12:
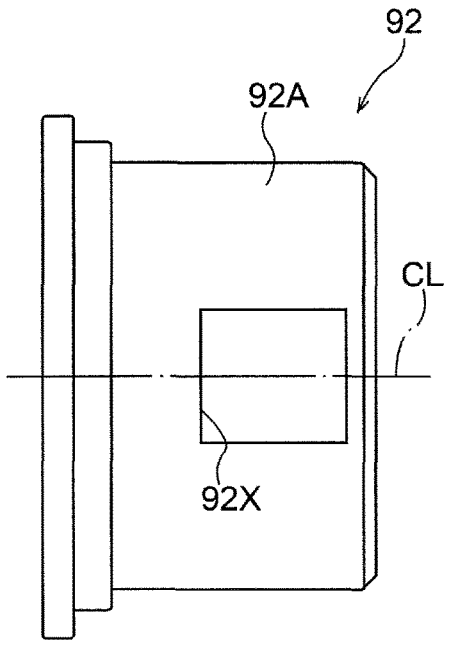
FIG. 12: is a side elevational view showing the control cage of the projector shown in FIG. 10.

Also, a single opening 92X is formed on the outer perimeter wall 92A of the control cage 92, extending through the outer perimeter wall 92A and serving as a projection material discharge portion. As shown in FIG. 12, which is a side elevational view of the control cage 92, the control cage 92 the opening 92X is configured in a rectangular shape, including two sides parallel to the cylinder axial center CL.

The cylinder portion 82A of the hub 82, which is a flanged cylindrical body, is fixed by a key to the outer circumference of the rotary shaft 76X of the drive motor 76 shown in FIG. 11. A center plate 90 is bolt-fixed to the hub 82. A distributor 94 is fixed by a bolt 84 to the tip portion 76A of the drive motor 76, through the center plate 90.

As shown in FIG. 10, the cylindrical distributor 94 internally comprises multiple radially extending blades 94A, and multiple openings disposed at equal spacing in the circumferential direction; these are disposed on the inside of the control cage 92 to form a gap relative to the control cage 92.

The distributor 94 rotates by the operation of the drive motor 76 (see FIG. 11), rotating inside the control cage 92. Rotation of the distributor 94 results in projection material supplied to the inside of control cage 92 from the introducing tube 70 being stirred inside the distributor 94 and then, by the centrifugal force of the spinning distributor 94, being supplied through the distributor 94 opening to the gap between the distributor 94 and the control cage 92. Projection material supplied to this gap moves within the gap in the rotational direction along the inner circumferential surface of the control cage 92, and is discharged in a radially outward direction from the opening 92X in the control cage 92.

At this point the discharge direction of projection material from the opening 92X in the control cage 92 is inclined in the rotational direction of the impeller 100 (the direction of arrow R) relative to the radial direction from the rotational center of the distributor 94 (same as the rotational center C of the impeller 100, described below).

As shown in FIGS. 11 and 24, a flange 82B radially outward extending from one axial end of the cylinder portion 82A of the hub 82, is fixed by bolt to the ring-shaped first side plate 102A of the side plate unit 102. The side plate unit 102 constitutes a portion of an impeller 100 disposed on the outer circumferential side of the control cage 92. The impeller 100 is attached through a hub 82 to the rotary shaft 76X of the drive motor 76. The impeller 100 comprises a first side plate 102A and a ring-shaped second side plate 102B disposed to face the first side plate 102A, separated by a gap. The first side plate 102A and second side plate 102B are linked by a linking member 102C.

In addition, the impeller 100 comprises multiple blades 104, disposed to extend in the radially outward direction of the control cage 92, between the first side plate 102A and the second side plate 102B. The impeller 100 obtains rotational force from the operation of the drive motor 76 (FIG. 11) and rotates in the circumferential direction of the control cage 92. The rotational direction of the impeller 100 and the rotational direction of the distributor 94 are set to be the same.

Each of the blades 104 is oriented in inclined manner such that the radially outward end thereof is positioned rearward of the radially inward end relative to the rotational direction of the impeller 100 (arrow R direction), and disposed along the outside circumference of the control cage 92.

As shown in FIG. 23, in the projector 20, the rotational direction of the impeller 100 (see direction of arrow R) is set so that when viewed from the direction of the rotational center of the impeller 100, the blades 104 of the impeller 100 move in the following order: apparatus upper direction, processing zone 18 direction and apparatus lower direction.

Figure 14:
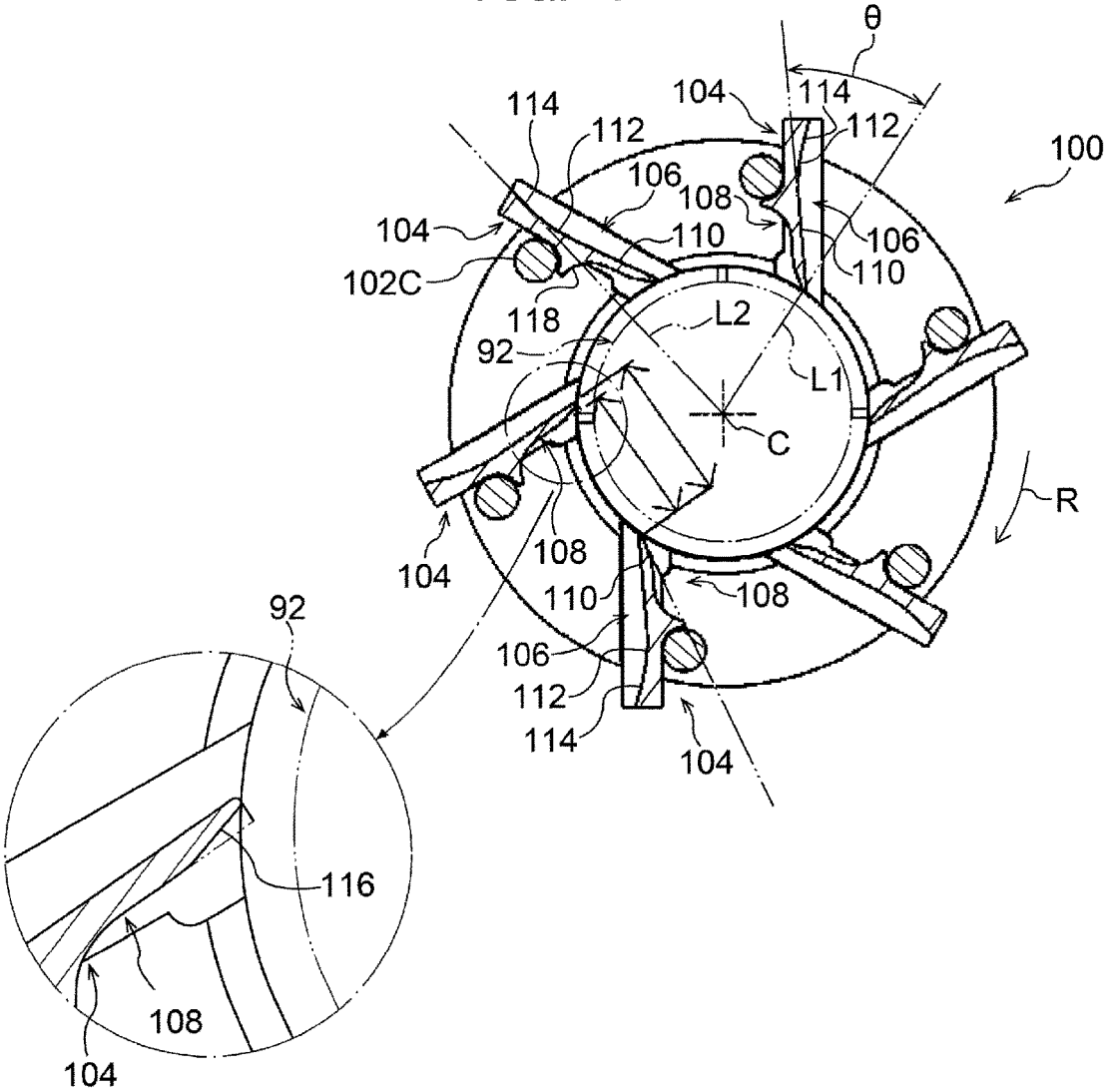
FIG. 14: A cross sectional view viewed in front elevation showing the impeller in the FIG. 10 projector.

FIG. 3 is a perspective view of the blades 104; FIG. 14 is a cross sectional view from the front of the impeller 100.

As shown in FIG. 14, the surface 106 on the rotational direction side of the blades 104 comprises, on the radially inward (base end) portion thereof, a rearward inclining portion 110, inclining to the rearward in the rotational direction. A rearward inclining portion 110 preferably inclines to the rotational direction rear at an angle of 30° to 50° relative to the radial direction of the impeller 100; in the present embodiment it inclines at 40°.

Also, a rearward less-inclining portion 114 extending in approximately the radial direction (the radial line L2 direction) from the rotational center C of the impeller 100 is formed on the tip end portion in the surface 106 of the blades 104 (i.e., on the radially outward of the rearward inclining portion 110). The radial length of the rearward inclining portion 110 is set to be longer than the radial length of the rearward less-inclining portion 114. A curved portion 112 is formed between the rearward inclining portion 110 and the rearward less-inclining portion 114.

In the rearward less-inclining portion 114, it is sufficient for the inclination angle thereof toward the rotational rearward direction to be set smaller than that of the rearward inclining portion 110.

Also, the reverse surface 108 on the opposite to the surface 106 of the blade 104 has at its base portion a inclined portion 116, which inclines larger than the rearward inclining portion 110 in rotational rearward direction relative to the radial direction. A projection 118 is raised on the radial middle portion of the surface 108 of the blades 104. On this projection 118, the indented curved portion on the radial outer side of the impeller 100 contacts the linking member 102C.

Figure 13:
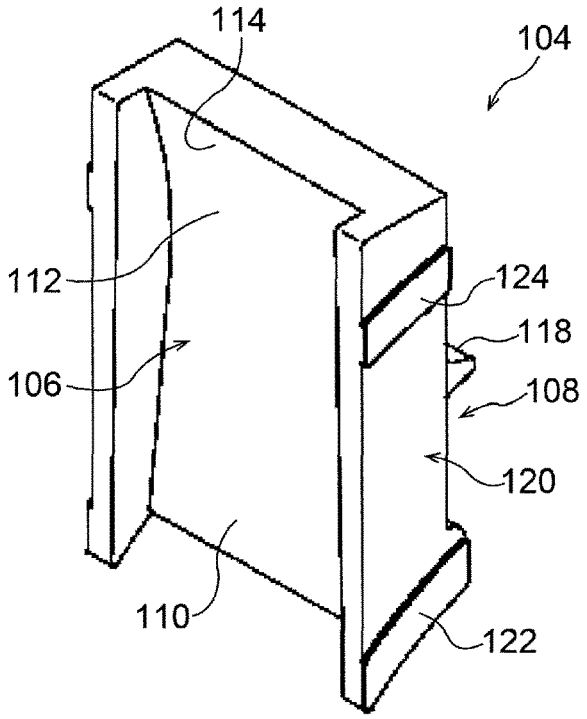
FIG. 13: is a perspective view of a blade constituting the projector shown in FIG. 10.

As shown in FIG. 13, a side wall portion 120 extending from the surface 106 outward in the thickness direction of the blades 104 is formed on both side portions of the surface 106 of the blades 104. A base end stepped portion 122, projecting outward in the width direction of the side wall portion 120 in a step shape, is formed on side wall portion 120 at the base end of the blades 104. Also, a tip-end raised portion 124, projecting outward in the width direction of the side wall portion 120 in a step shape, is formed on the side wall portion 120. The base end stepped portion 122 and a tip-end raised portion 124 extend on the base portion (lower side in the figure) in slightly inclined manner in a direction toward from the reverse surface 108 to the surface 106.

The side wall portion 120 is a portion which is fitted into the channel portion of the first side plate 102A and the second side plate 102B shown in FIG. 11. The base end step portion 122 and tip-end raised portion 124 shown in FIG. 13 are sites on the blades 104 which contact the bottom surface of the channel portion in the first side plate 102A and second side plate 102B shown in FIG. 11.

Next, referring to FIG. 5 and FIGS. 21 through 23, shot processing by the shot blasting apparatus 10 of the present embodiment will be explained. Note that FIGS. 21 and 22 are cross sectional diagrams from the same direction as FIG. 5B, which depicts each step of shot processing by a shot blasting apparatus.

Figure 21B:
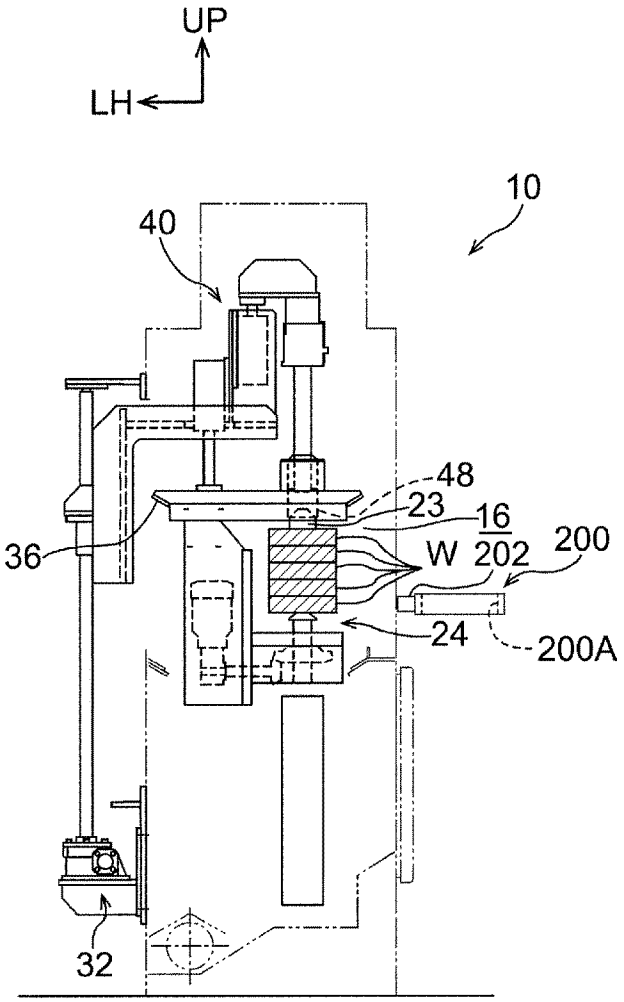
FIG. 21: is a diagram explaining shot processing by the shot blast processing apparatus shown in FIG. 1; (A) shows a state in which the inner lid is lowered; (B) shows a state in which the hold-down portion is lowered.
Figure 21A:
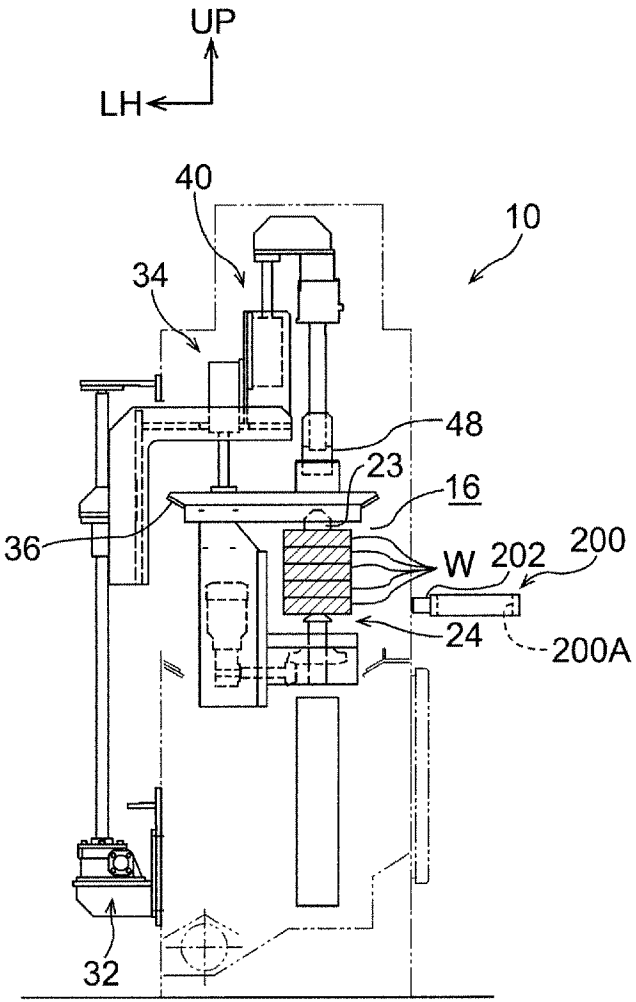

First, as shown in FIG. 5B, a workpiece W is loaded into the loading/unloading zone 16, and set in the work receiving portion 24. Next, as shown in FIG. 21A, the inner lid 36 is lowered by operating the first cylinder mechanism 34. In addition, as shown in FIG. 21B, the second cylinder mechanism 40 is operated, the hold-down portion 48 is lowered, and the workpiece W is held down from above by the hold-down portion 48 through a cap 23.

Figure 22A:
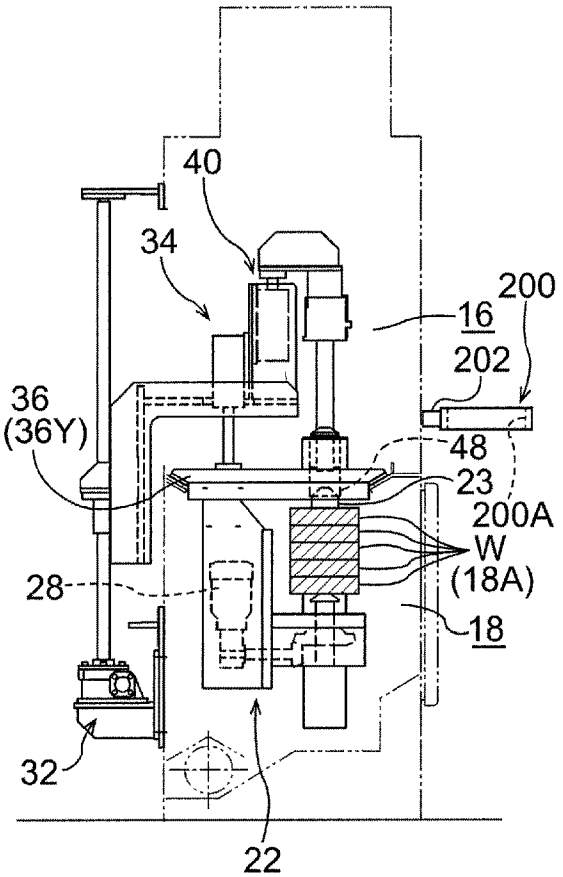
FIG. 22: is a diagram for explaining shot processing by the shot blast processing apparatus shown in FIG. 1; (A) shows a first projection position; (B) shows a second projection position; (C) shows a third projection position.
Figure 23A:
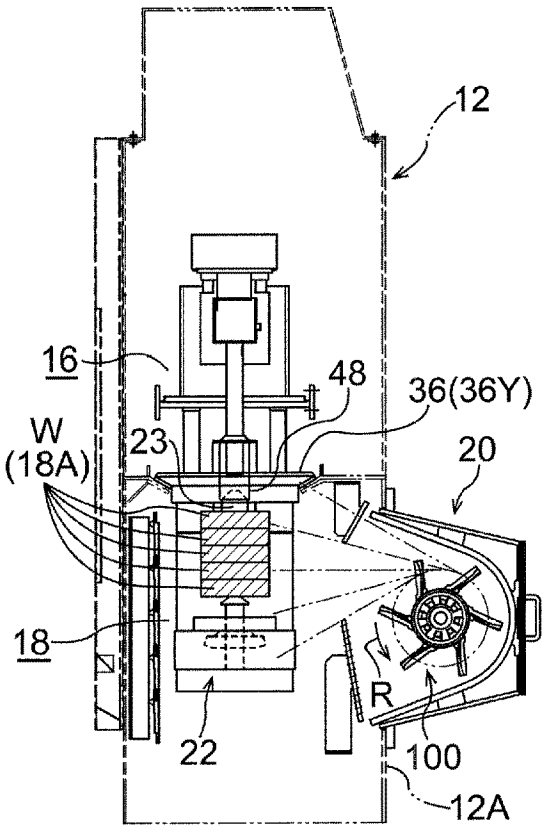
FIG. 23: is a diagram for explaining shot processing by the shot blast processing apparatus shown in FIG. 1; (A) shows the projection state at the first projection position; (B) shows the projection state at the second projection position; (C) shows the projection state at the third projection position.
Figure 23B:
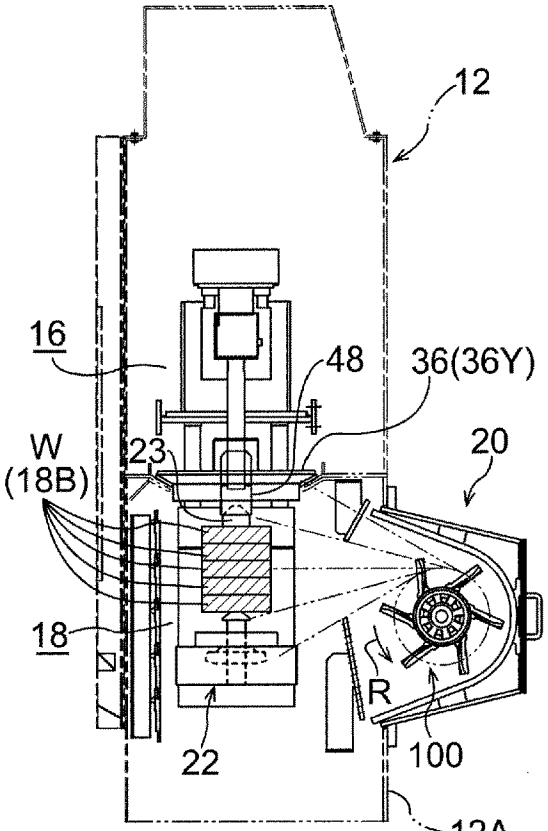

Next, as shown in FIG. 22A, the jack 32 is operated to lower the workpiece W and inner lid 36. Thus, the workpiece W is disposed at a first projection position 18A, being a first processing position in the processing zone 18, and the inner lid 36 is disposed in a second position 36Y, partitioning the loading/unloading zone 16 and the processing zone 18. By operation of the motor 28 in this state, the workpiece W rotates about the vertical axis, and by operation of the drive motor 76 (FIG. 11), the impeller 100 rotates and projection material is projected, as shown in FIG. 23A.

As a result, surface treatment is performed on the entire circumference of the workpiece W. In a state shown in FIG. 23A, workpieces W disposed at the bottom position among multiple stacked workpieces W are primarily subjected to shot processing.

Because the inner lid 36 partitions the loading/unloading zone 16 and the processing zone 18, leakage of projection material to the loading/unloading zone 16 side is prevented. In the present embodiment, as shown in FIG. 23, the rotational direction of the impeller 100 (see direction of arrow R) is set so that, when viewed from the direction of the rotational center of the impeller 100, the blades move in the following order: apparatus upper direction, processing zone 18 direction and apparatus lower direction. This arrangement also results in limiting the leakage of projection material to the upper portion.

Moreover, in the present embodiment the hold-down portion 48 provided in the raising/lowering rotation mechanism 22 can extending through the inner lid 36, and can rotate about the vertical axis together with the workpiece W, holding the workpiece W from above. Hence even if multiple workpieces W supported by the raising/lowering rotation mechanism 22 are stacked, the workpiece W can be stably rotated about axis extending in a raising/lowering direction.

Figure 22B:
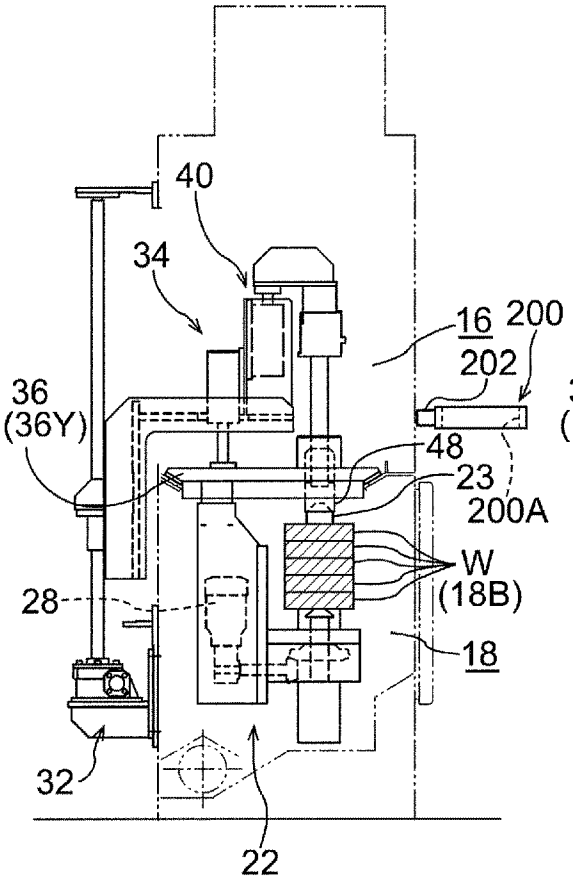

Next, the shot gate on the flow quantity adjustment device 68 (see FIG. 6) is closed, and projection of projection material is stopped. While the workpiece W is rotated about the vertical axis, the workpiece W is lowered through operation of the jack 32, as shown in FIG. 22B, and placed in a second projection position 18B, being the second processing position in the processing zone 18.

Next, projection of projection material from the projector 20 is restarted by opening the shot gate on the flow quantity adjustment device 68 (FIG. 6). In a state shown in FIG. 23B, among the multiple stacked workpieces W, the part disposed in the vertically middle position is primarily subjected to shot processing.

Figure 22C:
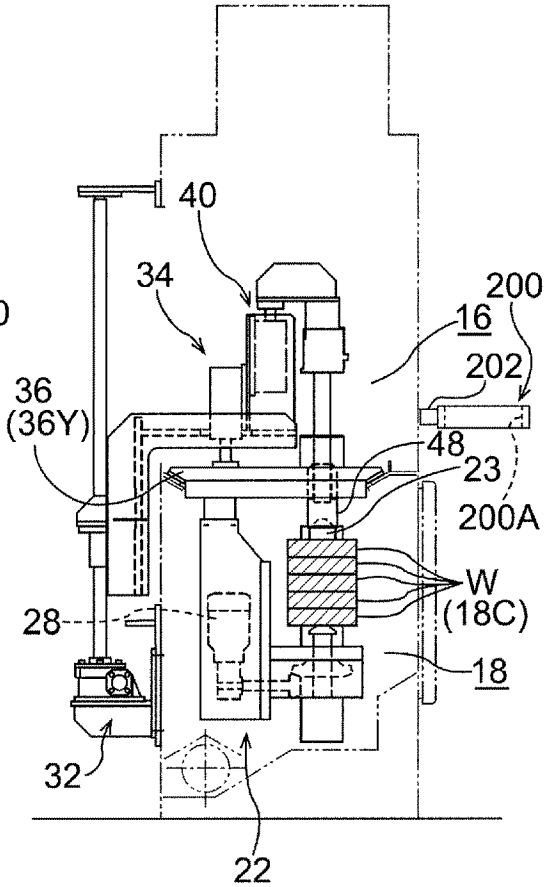

Next, the shot gate on the flow quantity adjustment device 68 (FIG. 6) is closed, and projection of projection material is stopped. Then, while the workpiece W is rotated about the vertical axis, the workpiece W is lowered through operation of the jack 32, as shown in FIG. 22C, and placed in third projection position 18C, being the third processing position in the processing zone 18.

Figure 23C:
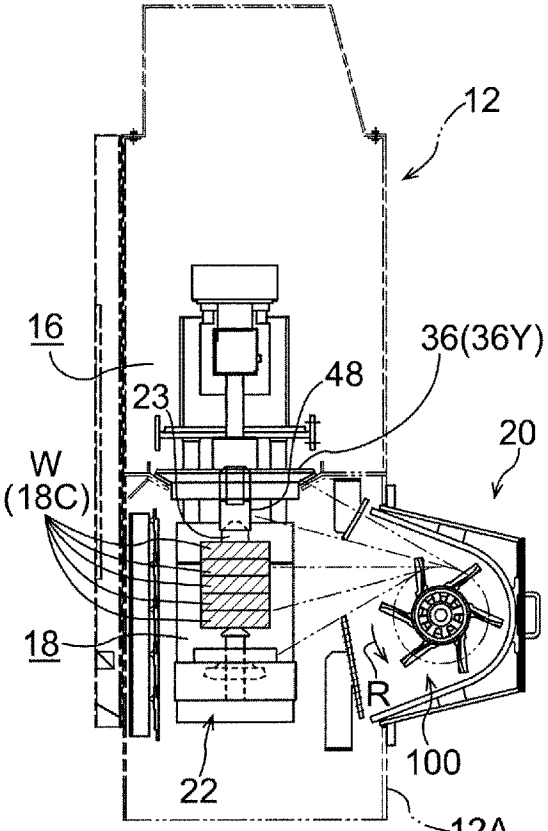

Next, by opening the shot gate on the flow quantity adjustment device 68 (FIG. 6), projection of projection material from the projector 20 shown in FIG. 23C is restarted. In a state shown in FIG. 23C, among the multiple stacked workpieces W, the part disposed in the upper position is primarily subjected to shot processing.

Thus, by the operation of the raising/lowering rotation mechanism 22 jack 32, workpieces W is sequentially lowered in the processing zone 18 so that shot processing is applied to all of the multiple stacked workpieces W.

In this embodiment, projection of projection material by the projector 20 is stopped when the workpiece W is lowered in FIGS. 22 and 23, but it is also possible to lower the workpiece W while continuing the projection of projection material by the projector 20.

Next the procedure up to conveyance of the workpiece W will be explained. As shown in FIG. 23C, when a desired surface treatment is applied to a workpiece W, the shot gate on the flow quantity adjustment device 68 (FIG. 6) is closed, and projection of projection material is stopped. In addition, the drive motor 76 for the projector 20 (FIG. 11) is stopped.

Next, the second cylinder mechanism 40 shown in FIG. 22C is operated, raising the hold-down portion 48. Next, the first cylinder mechanism 34 is operated, raising the inner lid 36. Thus a gap (space) is formed between the hold-down portion 48/inner lid 36, and the workpiece W.

Next, the jack 32 is operated, and the hold-down portion 48, the inner lid 36, and the workpiece W is raised while maintaining the relative positional relationships between the hold-down portion 48, the inner lid 36, and the workpiece W. The jack 32 is stopped when the height of the gap between the hold-down portion 48/inner lid 36 and the workpiece W reach the same height as the workpiece inspection apparatus 200 height.

In this state, the rotary arm 202 is operated, the workpiece inspection apparatus 200 which had been in a retracted position is inserted into the gap between the hold-down portion 48/inner lid 36 and the workpiece W, then moved to an inspection position (the position shown by the double dot and dash line in FIG. 5B).

Next, after the jack 32 is operated and the top-most gear (the target object) in the workpiece W is raised to a position at which it is surrounded by the workpiece inspection apparatus 200, the jack 32 is stopped. The workpiece inspection apparatus 200 then non-destructively inspects the condition of the side portion of the top-most gear within the workpiece W.

After completion of inspection of the top-most gear, the jack 32 is operated to raise the second gear from the top of the workpiece W to a position at which it is surrounded by the workpiece inspection apparatus 200, whereupon the jack 32 is stopped. The workpiece inspection apparatus 200 then non-destructively inspects the condition of the side portion of the second gear down within the workpiece W.

Thereafter non-destructive inspection of each workpiece W is similarly conducted in sequence. FIG. 5B shows a state wherein the workpiece inspection apparatus 200, shown by a double dot and dash line, surrounds the side surface of the bottom-most gear in a workpiece W. After completion of non-destructive inspection of this bottom-most gear, the jack 32 is operated to lower the workpiece W without changing the relative positional relationship between the hold-down portion 48/inner lid 36 and the workpiece W. Then, by operating the rotary arm 202, the workpiece inspection apparatus 200, which is in the inspection position, is moved to the retracted position.

After that, by operating the jack 32, the hold-down portion 48/inner lid 36 and the workpiece W can, without changing their relative positional relationship, be raised and placed at the position in the loading/unloading zone 16 shown in FIG. 5B. The workpiece W, set in the work receiving portion 24, is then unloaded from the loading/unloading zone 16.

Note also that in the present embodiment, the workpiece W is non-destructively inspected by the workpiece inspection apparatus 200 after being surface treated by the projector 20, but in an alternative embodiment in which no workpiece inspection apparatus 200 is provided, the procedure up to workpiece W unloading is as follows.

I.e., as shown in FIG. 23C, at the timing when the desired surface treatment is applied to a workpiece W, the shot gate on the flow quantity adjustment device 68 (FIG. 6) is closed, and projection of projection material is stopped. The drive motor 76 for the projector 20 (FIG. 11) is also stopped. Subsequently, operation of the jack 32 (FIG. 21B) causes the workpiece W and the hold-down portion 48/inner lid 36 to be raised, as shown in FIG. 21B. The workpiece W and the hold-down portion 48/inner lid 36 are then placed in the loading/unloading zone 16.

Next, the hold-down portion 48 is raised by operating the second cylinder mechanism 40, as shown in FIG. 21A. Thereafter, by operating the first cylinder mechanism 34, the inner lid 36 is raised and placed in the first position 36X, as shown in FIG. 5B. The workpiece W, set in the work receiving portion 24, is then unloaded from the loading/unloading zone 16.

Note that in the present embodiment, as shown in FIG. 23, the projector 20 is disposed in the side of the processing zone 18 on the side wall portion 12A of the cabinet 12. I.e., the projector 20 is placed on the lower position in the cabinet 12 (lower portion of the apparatus), so the overall height of the apparatus can still be reduced even if the shot tank 66 or the like shown in FIG. 6 is placed at upper position than the projector 20 in the apparatus.

Next, referring to FIGS. 6 through 9, the operation of a circulation mechanism 50 for circulating projected projection material will be explained.

Projection material which has been projected by the projector 20 and has fallen, is conveyed by a screw conveyor 52 to the bottom end of a bucket elevator 54. At that time, in addition to reusable projection material, the screw conveyor 52 also conveys dust produced by the breakup of the projection material, etc. The first row conveyor 55A of the bucket elevator 54 shown in FIGS. 7B and 9 conveys projection material and dust from the apparatus bottom portion to the upper portion in the apparatus, supplying projection material and dust to the inlet 56A of the separator 56 shown in FIGS. 7B and 8.

The separator 56 separates and excludes dust from the projection material and dust supplied from the inlet 56A and discharges the projection material to the bottom end of the second row conveyor 55B on the bucket elevator 54. The second row conveyor 55B of the bucket elevator 54 conveys projection material discharged from the separator 56 (FIG. 7B) from the lower portion of to the upper portion of the apparatus, supplying projection material to the shot supply port 66A of the shot tank 66 shown in FIG. 7A.

The shot tank 66 stores projection material supplied to the shot supply port 66A for use in supplying the projector 20. The shot tank 66 supplies projection material to the projector 20 through the flow quantity adjustment device 68 and the introducing tube 70.

Operation/Effect

Next the operation and effect of a shot blasting apparatus 10 according to the embodiment above will be explained.

In the shot blasting apparatus 10 of the embodiment above, as shown in FIG. 12, the opening 92X of the control cage 92 is given a rectangular shape which includes two sides parallel to the cylinder axis CL of the control cage 92. Projection material is therefore discharged in a concentrated form from the same position in the circumferential direction of the control cage 92.

Also, in the impeller 100, disposed on the radially outward position of the control cage 92 as shown in FIG. 10, and multiple blades 104 rotate in the circumferential direction of the control cage 92, therefore projection material discharged from the opening 92X of the control cage 92 is accelerated by the blades 104 and projected toward a workpiece W.

Figure 15A:
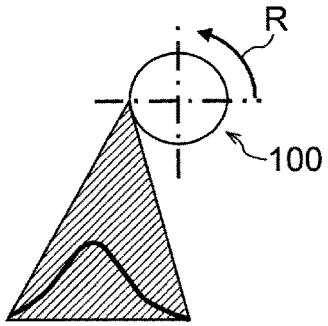
FIG. 15: (A) is a diagram showing the projection distribution when projection is done by using a control cage shown in FIG. 12; (B) is a plan view showing the projection range when projection is done by using the control cage shown in FIG. 12.
Figure 15B:
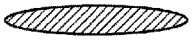

FIG. 15A shows the projection distribution when projecting using the control cage 92 in FIG. 12. As shown in FIG. 15A, when the control cage 92 shown FIG. 12 is used, the projection material distribution follows a projection distribution curve in which there is only one peak, at the center of the distribution width. FIG. 15B is a plan view showing the projection range when projecting using the control cage 92 shown in FIG. 12.

Using the shot blasting apparatus 10 of the above embodiment, a rearward inclining portion 110, inclining rearward in the rotational direction (the arrow R direction) relative to the radial direction (the radiating direction line L1), is formed on the surface 106 of the impeller 100 blades 104. This enables projection material to be collected on the surface 106 of blades 104.

In this regards, explanation will be made by comparison to a comparative example, referring to FIGS. 16 and 17. FIG. 16 is a schematic diagram explaining the effect of an impeller I1 in which blades B1 are rearwardly inclined in the rotational direction (inclining from the impeller I1 radial direction toward the rearward direction of the rotational direction (the arrow R direction).

FIG. 17, on other hand, is a schematic diagram explaining the operation of an impeller I2 in a comparative example, in which blades B2 extend in the radial direction. Note that in both FIGS. 16 and 17, A through G are arranged in order of time sequence.

Figure 17A:
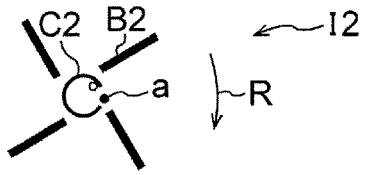
FIG. 17: is a schematic diagram for explaining the operation of a comparative example in which the blades extend in a radial direction.
Figure 17B:
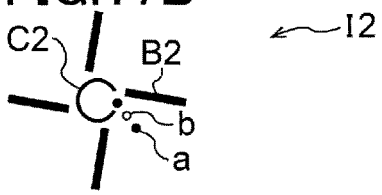
Figure 17C:
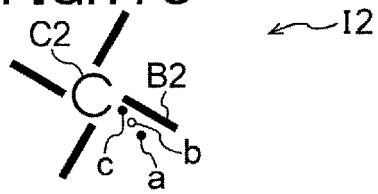

First, referring to FIG. 17, the operation of the comparative example will be explained. As shown in FIGS. 17A through 17C, projection material a, projection material b, and projection material c are discharged at a fixed interval in sequence from an opening in the control cage C2, in a direction inclined toward a rotational direction of the impeller 100 (the arrow R direction) relative to the radial direction.

Figure 17D:
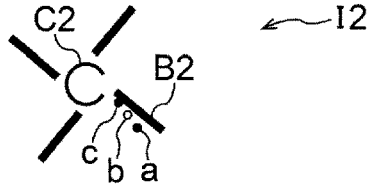
Figure 17E:
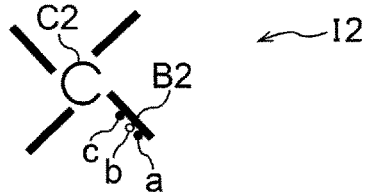

As shown in FIGS. 17D and E, projection material c discharged third, then projection material b discharged second, and finally projection material a, discharged first, hit the surface of blade B2.

Figure 17F:
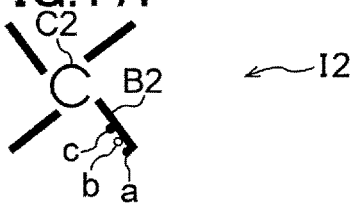
Figure 17G:
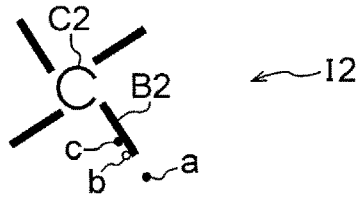

Projection materials a, b, and c are respectively accelerated toward the tip end of the blade B2, however because the timing at which each of them hits the blade B2 is as described above, and the degree of acceleration of projection material increases as it moves toward the blade B2 tip end, projection materials a, b, and c cannot be collected on the blade B2, as shown in FIG. 17F. As shown in FIG. 17G, the first-discharged projection material a is projected. Although not shown, the projection material b and projection material c are then projected at offset timings, in that order. Thus when the blade B2 of impeller I2 is disposed to extend radically, projection material cannot be concentrated and projected.

Figure 16A:
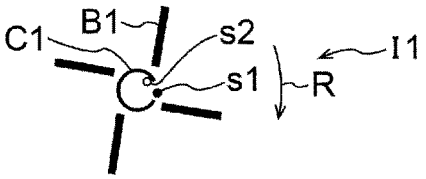
FIG. 16: is a schematic diagram for explaining the operation of a arrangement in which blades are rearward inclined.
Figure 16B:
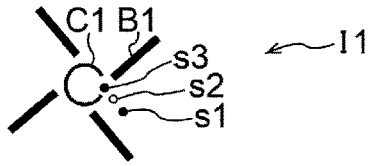
Figure 16C:
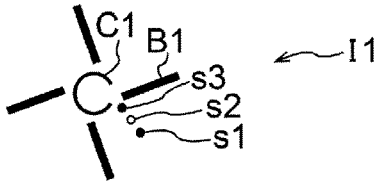

On the other hand, even in the configuration shown in FIG. 16, in which a blade B1 is rearwardly inclined in the rotational direction, projection material s1, projection material s2, and projection material s3 are discharged in sequence from an opening on a control cage C1, as shown in FIGS. 16A through 16C.

Figure 16D:
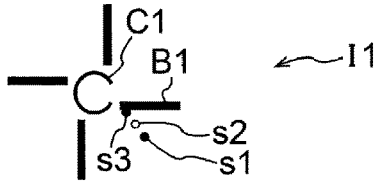

In this arrangement, as shown in FIG. 16D, the blades incline toward a rotationally rearward direction of the impeller, and the discharge direction of the projection material inclines in the rotational direction of the impeller 100; furthermore a rearward inclining portion is formed on the blade surface, so the last-discharged projection material s3 hits the blade B1 and is accelerated toward the tip end of the blade B1 before the first-discharged projection material s1 and second-discharged projection material s2 hit the surface of the blade B.

Figure 16E:
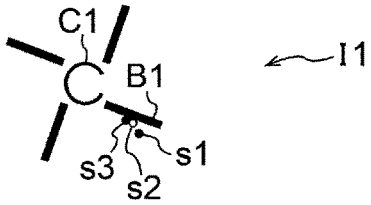

Next, as shown in FIG. 16E, the second-discharged projection material s2 hits the surface of the blade B1. At this point, the radial position on the blade B1 of the projection material s3 which had been already accelerated is essentially the same position as the radial position on the blade B1 of the projection material s2. As a result, the projection materials s3 and s2 are accelerated toward the tip end of the blade B1 in essentially a clump.

Figure 16F:
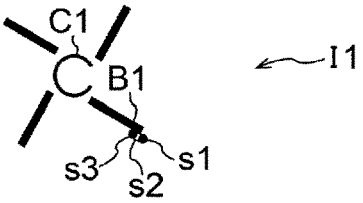

Next, as shown in FIG. 16F, the first-discharged projection material s1 hits the surface of the blade B1. At this point, the radial position on the blade B1 of the projection material s3 and s2, which had been already accelerated on the blade B1, is essentially the same position as the radial position on the blade B1 of the projection material s1. Thus the projection materials s3, s2, and s1 form approximately a clump, and are accelerated toward the tip end of the blade B1.

Figure 16G:
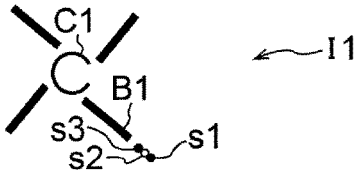

Then, as shown in FIG. 16G, projection materials s3, s2, and s1 are more or less clumped and simultaneously projected. Thus in the arrangement in which the blade B1 of the impeller 11 is inclined rearward, the projection materials s3, s2, and s1 collected on the blade B1 are projected, therefore the projection distribution can be concentrated. Thus wasteful projection onto the workpiece W can be reduced.

In the projector 20 of the present embodiment, the surface 106 on the rotational direction of the impeller 100 comprises, on the inward part in the radial direction (base end portion) thereof, a rearward inclining portion 110 rearwardly inclining 40° in the rotational direction relative to the radial direction.

By reducing an inclining angle of the rearward inclining portion toward the rotationally rearward direction to 30° or greater, a sufficient time difference can be secured for projection material to get onto the blade, thereby enabling the concentration of the projection distribution to be improved. In addition, by adopting an angle of 50° or less for the rotational direction rearward inclining angle of the rearward inclining portion, the time difference for projection material getting onto the blade can be a much more preferable time difference; projection material is concentrated on the blade, and the length of the blade can be constrained.

Note that constraining blade length not only results in constraining blade weight and parts cost, but also has the advantage of easier workability during assembly, etc.

Figure 18:
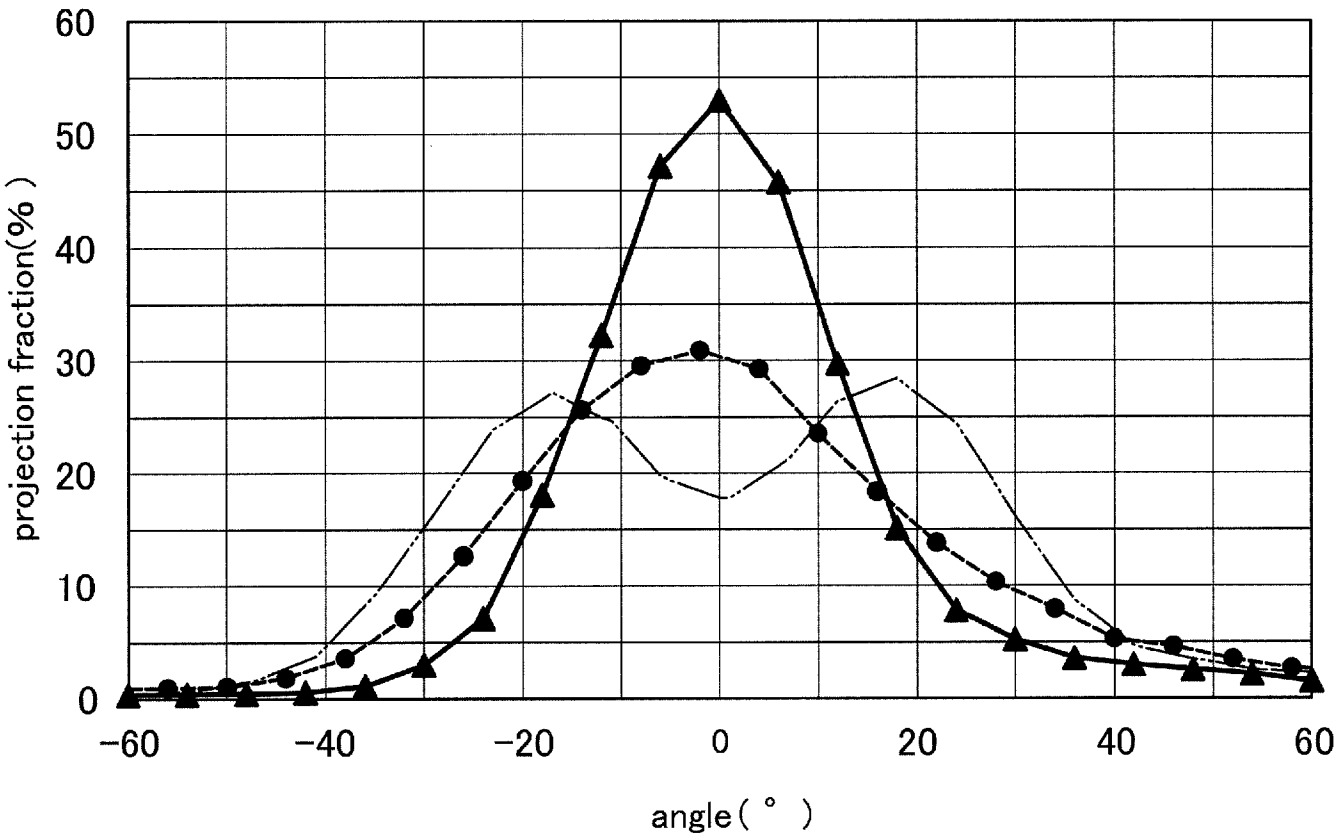
FIG. 18: is a graph showing projection distributions comparing the case where blades do not incline and the case where blades incline rearward.

This point will be explained concretely referring to FIG. 18. FIG. 18 shows a graph of projection distribution, comparing a case in which a blade extends along the radial direction from the rotational center of the impeller (simply "blade not inclined" below), and a case in which a blade is inclined rearward (arrow R direction) of the rotational direction relative to the radial direction of the impeller (simply "blade inclined" below).

In FIG. 18, the vertical axis shows the projection fraction and the horizontal axis shows, by an angle, the projection range at the processing position and at an extended position thereof on a plane when the straight line along the projection center from the projection position of the projection material by the projector is assumed to be 0°. In FIG. 18, the solid line plot represents the present embodiment, and the dotted line plot represents a comparative example in which the blade is not inclined. As an alternative embodiment, the plot represented by a double dotted line in FIG. 18 will be explained below.

As shown in FIG. 18, in the present embodiment case (see the solid line), it is clear that compared to the comparative example case (see the dotted line) the projection distribution is more concentrated around 0°. In the range of −15° to +15°, the projection fraction is higher in the present embodiment (see solid line) than in the comparative example (see dotted line). Therefore viewed in the direction of the impeller rotary shaft, when the angle between the projection position of material projected by the projector and the position of both edges of the face oriented toward the projector of a workpiece disposed in the processing position is within 30°, the fraction of projection effective for surface treatment can be raised more in the present embodiment (see solid line) than in the comparative example (see dotted line).

In the case of the comparative example (see dotted line) shown in FIG. 18, not only an increase of the "wasted shots," in which the projection material does not hit the workpiece, but the projection material not hitting the workpiece hits the cabinet and liner, etc., shortening the life of those products. In the present embodiment (see solid line), by contrast, the amount of projection material directly hitting the cabinet and liner, etc. is reduced, so consumable parts costs can be reduced, greatly reducing total running cost.

Here further explanation from another standpoint will be added. Air jetting machines for jetting compressed air containing projection material from a nozzle are known for concentrating projection material in a narrow projection distribution range. However with air jetting machines, the quantity of projection material which can be accelerated and projected is extremely small relative to the power consumed to produce the compressed air, so electrical power efficiency for projection is poor. I.e., power consumption increases with an air jetting machine.

By contrast, the projector 20 of the present embodiment is a centrifugal projector, so projection material can be efficiently projected relative to power consumption. Therefore, by applying the projector 20 of the present embodiment instead of an air jetting machine, power consumption and by extension running costs can be greatly reduced.

In the present embodiment, a rearward less-inclining portion 114, extending in approximately the radial direction from the rotational center of the impeller 100 (the radial line L2 direction), is formed at the tip end of the surface 106 on the blade 104. This rearward less-inclining portion enables the velocity of projection material concentrated at the rearward inclining portion 110 to be accelerated for projection.

Figure 19A:
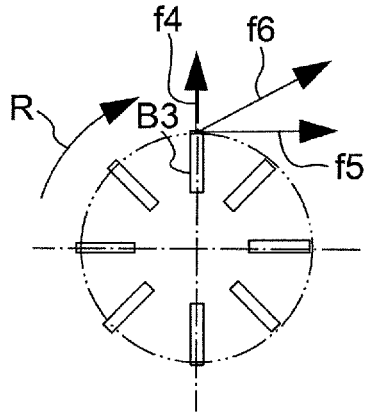
FIG. 19: is a schematic diagram for explaining projection velocity; (A) shows the case in which blades do not incline; (B) shows the case in which blades incline rearward.
Figure 19B:
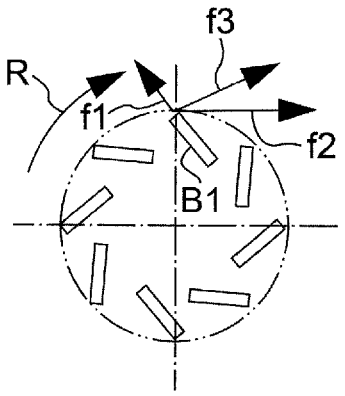

This point will be explained in detail using FIGS. 19 and 20. FIG. 19 is a schematic for explaining projection velocity. FIG. 19A shows the case when blade B3 is not inclined; FIG. 19B shows the case when the blade B1 is inclined rearward at 40°.

In FIG. 19A, f4 is the velocity in the direction of centrifugal acceleration; f5 is the velocity of the tip of the blade B3 in the tangential direction; f6 is the combined velocity of f4 and f5. In FIG. 19B, f1 is the velocity in the direction of centrifugal acceleration; f2 is the velocity of the tip of the blade B1 in the tangential direction; f3 is the combined velocity of f1 and f2. Note that in FIGS. 19A and 19B, the outside diameter of the blade rotation and the rotation circumferential velocity are set to the same. As shown in FIGS. 19A and 19B, the combined velocity f3 when the blade B1 is inclined is smaller than the combined velocity f6 when the blade B3 is not inclined. Therefore if all conditions are the same except for inclination angle of the blade, inclining the blade B1 to the rear results in a slower projection velocity than when the blade B3 is not inclined.

On the other hand, if the impeller is turned at a higher speed by the drive motor in order to increase the projection velocity, both noise and power consumption will increase. It also happens that when the drive motor rpm is increased, no-load power also rises.

Figure 20:
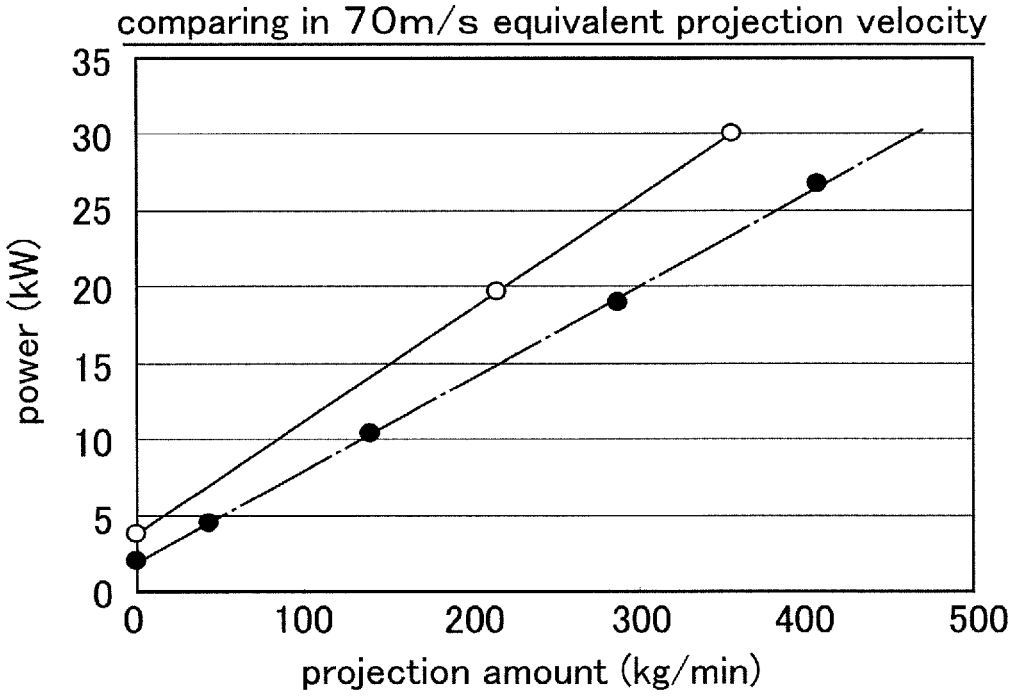
FIG. 20: is a graph showing the relationship between electrical power and projection amount for the case when blades are not inclined comparing to the case when blades are inclined rearward.

FIG. 20 shows a graph comparing power consumption between the case when the blade is inclined and the case when the blade is not inclined, assuming a 70 m/s equivalent projection velocity. In FIG. 20, the vertical axis shows power consumption, and the horizontal axis shows projection quantity per unit time. The plot shown by the solid line is for the case when the blade is rearwardly inclined; the plot shown by the dot and dash line is for the case when the blade is not inclined. As shown in this figure, simply rearwardly inclining the blade produces a disadvantage from a power consumption standpoint.

However in the present embodiment, projection material concentrated by the rearward inclining portion 110 shown in FIG. 14 is projected after its velocity has been increased by the rearward less-inclining portion 114, therefore projection can be done at the same projection power efficiency as when the blade is not inclined.

Also, in the present embodiment, as shown in FIG. 11, the impeller 100 is attached to the rotary shaft 76X of the drive motor 76 through a hub 82. Therefore, the apparatus as a whole can be reduced in size compared to the case when it is connected to the drive motor through a belt.

Also, in the present embodiment, the projection material is projected after the projection material has been accelerated by the rearward less-inclining portion 114, therefore the increase in impeller 100 rpm per unit time can be constrained, as can the increase in power consumption.

In the present embodiment, viewed in the direction of the impeller 100 rotary shaft, the length of the rearward inclining portion 110 is set to be longer than the length of the rearward less-inclining portion 114. Therefore the velocity of the projection material can be fully increased by the rearward less-inclining portion 114.

Also, in the present embodiment a curved portion 112 for smoothly connecting the rearward inclining portion 110 and the rearward less-inclining portion 114 is formed on the surface 106 of blades 104. Thus the velocity of the projection material can be gradually increased after projection material has been collected by the rearward inclining portion 110 of the blades 104.

In the present embodiment, the direction along which projection material is discharged from the opening 92X in the control cage 92 is inclined to the impeller 100 in rotationally forward direction.

Therefore the timing at which projection material discharged earlier from the opening 92X of the control cage 92 contacts the surface 106 of the blade 104 can be delayed, and projection material more effectively concentrated by the rearward inclining portion 110 on the surface 106 of the blade 104.

Also, in the present embodiment an inclined portion 116 is placed on the reverse surface 108 of the blades 104. When projection material discharged from the opening 92X contacts the base end portion of the reverse surface 108 of the blades 104 and is bounced back, the direction of the projection material bounce is deflected by the inclined portion 116, and the amount of bounce between blades 104 can be constrained. Disintegration of the flow of projection material between the blades 104 can thus be constrained.

In the shot blasting apparatus of the present embodiment, as shown in FIG. 8, the shot supply port 66A of the shot tank 66 is arranged to be adjacent to the inlet 56A of the separator 56, and the separator 56 is not placed above the shot tank 66, therefore the overall height of the apparatus can be constrained. Also, as shown in FIG. 9, the shared motor 54M and a single endless belt 54C are used for the bucket elevator 54, so the number of parts can be reduced, and the apparatus can be made smaller.

In the shot blasting apparatus of the present embodiment, as shown in FIG. 7B, a partitioning portion is provided close to only the lower portion of the endless belt 54C, partitioning the first row conveyor 55A and the second row conveyor 55B (see FIG. 7A). Hence the mixed material (projection material and dust) before dust is separated and removed by the separator 56 is prevented from mixing with the projection material after dust is separated and removed by the separator 56. Note that the complexity of the bucket elevator 54 structure is increased when a partitioning portion between the first row conveyor 55A and the second row conveyor 55B (FIG. 7A) is disposed over the entire height of the bucket elevator 54, but nothing of that nature occurs in this embodiment. Also, no partitioning portion is needed, because at the intermediate portion of the bucket elevator 54, projection material goes into the first buckets 54X and the second buckets 54Y.

As explained above, the amount of projection can be reduced using the shot blasting apparatus 10 of the present embodiment.

Figure 25:
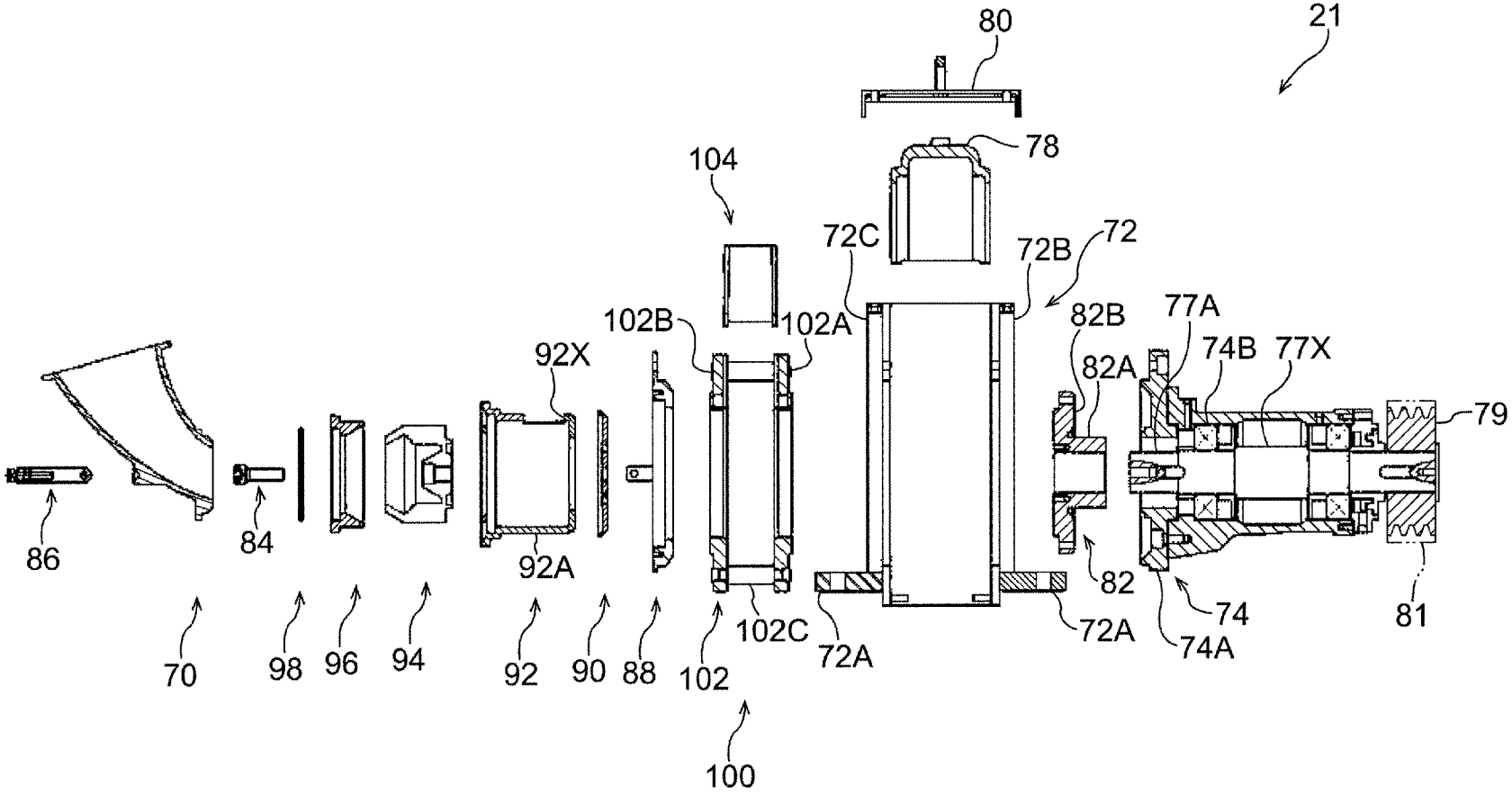
FIG. 25: is an exploded side elevational view of the projector shown in FIG. 24.

Note that as an alternative embodiment of the first embodiment above, it is also possible to use the projector 21 shown in FIGS. 24 and 25 in place of the projector 20 shown in FIGS. 10 and 11.

FIG. 24 is a vertical cross sectional view viewed from the side of a projector 21 in an alternative embodiment; FIG. 25 is an exploded side elevation of the projector 21.

As shown in these figures, the projector 21 differs in construction from the first embodiment in that the rotary shaft of the drive motor is not directly fixed to the hub 82. In other respects, it has the same arrangement as the first embodiment. Hence for those constituent parts which are the same as the first embodiment, the same reference numerals are applied and an explanation thereof will be omitted.

A through hole, through which the tip portion of the bearing unit 74 or the like is inserted, is formed on the side portion 72B on the middle right side of the case main unit 72, and a tip portion 74A of a bearing unit 74 is disposed in the center portion in the case main unit 72 shown in the right portion of the diagram. The tip portion 74A of the bearing unit 74 is attached to the side portion 72B of the case main unit 72 shown in the right side of the diagram. The hub unit 74 comprises a bearing 74B, and rotatably supports the rotary shaft 77X.

A second pulley 79 is fixed to the base end portion of rotary shaft 77X. A belt 81 is wound around the second pulley 79 and a first pulley, not shown. The first pulley is fixed to the rotary shaft of a drive motor, not shown. The rotational force of the drive motor is thus transferred to the rotary shaft 77X.

The cylinder portion 82A of the hub 82 on the flanged cylindrical body is disposed on the radially outward of the tip portion 77A of the rotary shaft 77X. A center plate 90 is bolt-fixed to the hub 82. The hub 82 is fixed by a key to the tip portion 77A of the rotary shaft 77X.

The amount of projection material can also be reduced in a shot blasting apparatus of such an alternative embodiment. Also, in this type of the alternative embodiment the size of the apparatus as a whole increases, but an advantage is gained in reduced power consumption.

Second Embodiment

Figure 26:
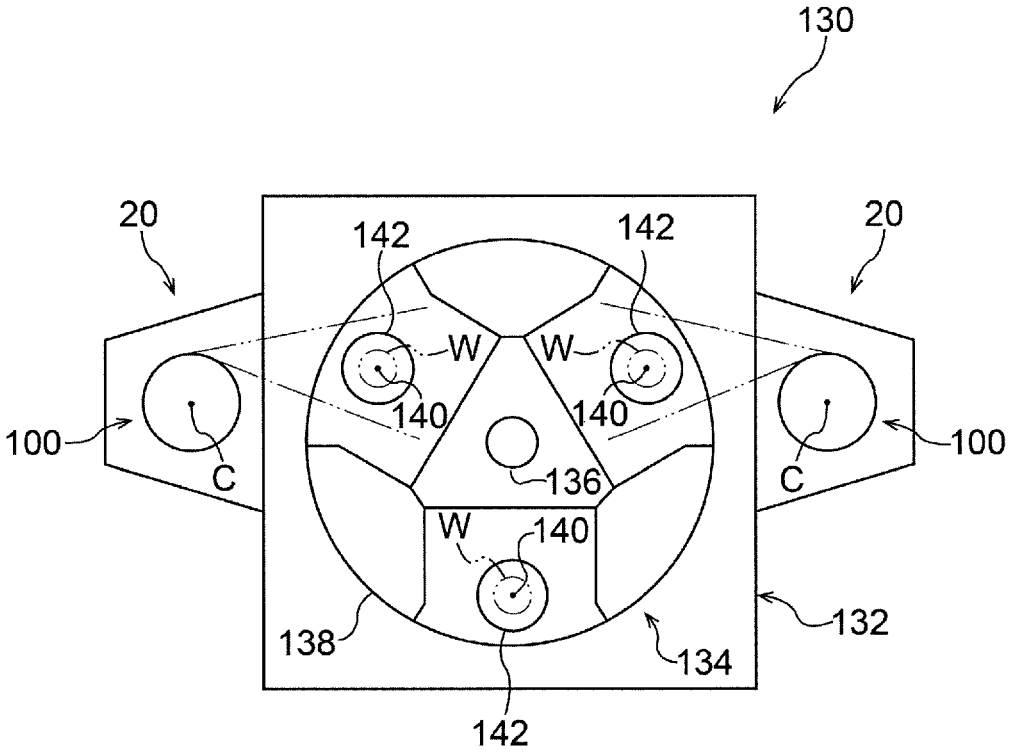
FIG. 26: is a schematic diagram schematically in horizontal section showing a part of a shot blasting apparatus of the second embodiment of the invention.

Next, referring to FIG. 26, a shot peening apparatus 130 as the shot processing apparatus in a second embodiment of the invention will be explained. FIG. 26 is a schematic diagram in a plan view of a shot peening apparatus 130 of the present embodiment.

Note that for elements which are substantially the same as those in the first embodiment, the same reference numerals will be applied and an explanation thereof will be omitted. The workpiece W processed by shot peening in this embodiment may be a product such as a gear, for example. The surface roughness of the workpiece W is reduced and the fatigue strength improved by shot peening.

As shown in FIG. 26, the shot peening apparatus 130 comprises a cabinet 132. A centrifugal projector 20 similar to the first embodiment shot blasting apparatus is installed on the side position in the cabinet 132. In the present embodiment the rotational center C of the impeller 100 extends in the vertical direction.

Inside the cabinet 132, a product mounting portion 134 is provided as a support mechanism to support the workpiece W in a processing position where surface treatment by the projector 20 is can be conducted. The product mounting portion 134 comprises a large table 138; multiple small tables 142 are disposed at equal spacing in the circumferential direction on the large table 138, at positions concentric with the large table 138.

The large table 138 is rotatable (orbit) about a vertical rotary shaft 136, and is disposed at a position which includes the projection range over which projection material is projected by the centrifugal projector 20.

Also, the small tables 142 have a smaller diameter than the large table 138, and comprise rotary shafts 140 parallel to the large table 138 rotary shaft 136; they can rotate (spin), and the workpiece W is placed on them.

A mechanism for holding down the workpiece W is provided at a position on the large table 138 corresponding to the projection range from the projector 20. This mechanism comprises a hold-down portion capable of holding down a workpiece W on the small tables 142 from above, and of rotating together with the workpiece W.

According to the present embodiment, as well, wasteful projection of projection material can be constrained, and the amount of projection can be reduced.

Other Embodiments

Next, referring to FIGS. 27 and 28, another projector, different from the projector used in the embodiment above will be explained. Note that in this projector, other than the difference in the shape of the control cage opening, the arrangement of the projector is the same as that of the projector 20 (FIGS. 10 and 11) used in the first embodiment shot blasting apparatus.

The control cages 150, 152, 154, 156, and 158 shown in FIGS. 27A through 27E are formed in a cylindrical shape, and projection material is supplied to the interior thereof. The centrifugal projector comprising these control cages 150, 152, 154, 156, and 158 is disposed in a shot processing apparatus, and projects projection material.

Figure 27A:
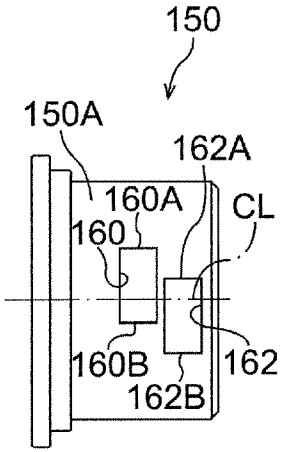
FIG. 27: (A) is a side elevational view showing a first alternative embodiment of a control cage; (B) is a side elevational view showing a second alternative embodiment of a control cage; (C) is a side elevational view showing a third alternative embodiment of a control cage; (D) is a side elevational view showing a fourth alternative embodiment of a control cage; (E) is a side elevational view showing a fifth alternative embodiment of a control cage.
Figure 27B:
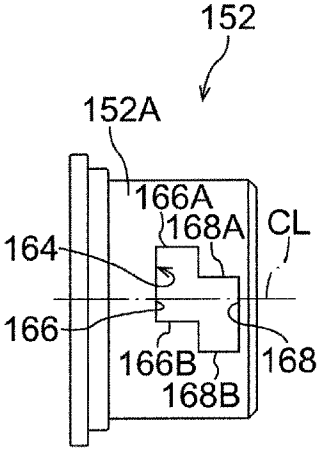
Figure 27C:
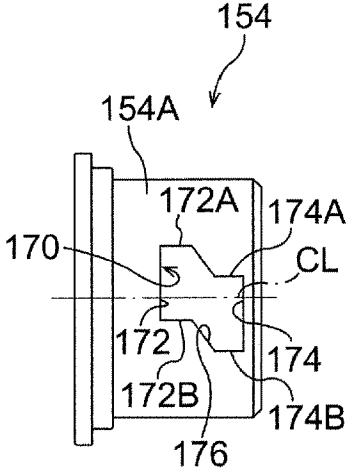
Figure 27D:
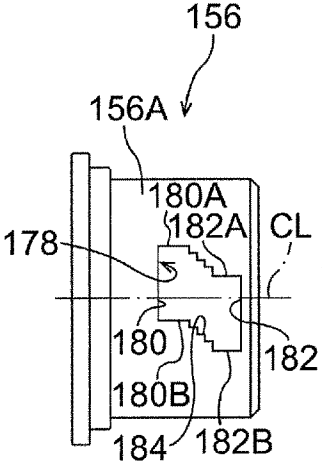
Figure 27E:
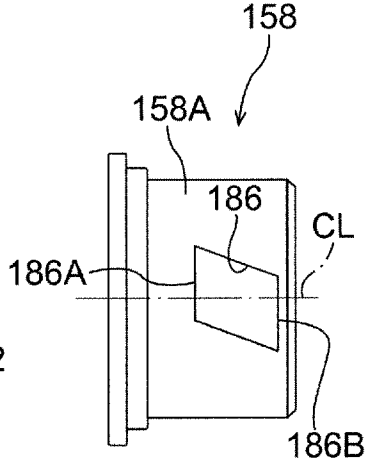

Note that the projector comprising the control cage 150, 152, 154, and 156 shown in FIGS. 27A through 27D of the present embodiment of the invention, and the projector comprising the control cage 158 shown in FIG. 27E is a reference example not included in the present invention.

In a projector comprising the control cages 150, 152, 154, and 156 shown in FIGS. 27A through 27D, viewed from the direction of the impeller rotary shaft, the dimensions, position, etc. of the workpiece W are selected so that, assuming the position of the projection material projected by the projector as the peak point, the angle at the peak point (peak angle) when both edges of the surface of opposing the projector on a workpiece W placed in the processing position is 50° to 80°.

A first opening portion 160 and a second opening portion 162 serving as projection material discharge portions are through-formed on the outer circumferential wall 150A of a control cage 150 shown in FIG. 27A.

The first opening portion 160 and second opening portion 162 both constitute openings in the control cage 150. The first opening portion 160 is placed between two mutually opposing parallel sides 160A and 160B, which are parallel to the cylinder axial center CL of the control cage 150.

The second opening portion 162 is set between two second parallel sides 162A and 162*b*, which are offset relative to the first opening portion 160 in the circumferential direction of the control cage 150 outer circumferential wall 150A and in the direction of the cylinder axial center CL.

The first opening portion 160 and second opening portion 162 are separated in the direction of the control cage 150 cylinder axial center CL, and approximately half of each overlap when viewed in the direction of the control cage 150 cylinder axial center CL.

Also, an opening 164 is through-formed as a projection material discharge portion on the outer circumferential wall 152A of the control cage 152 shown in FIG. 27B.

The opening 164 comprises a first opening portion 166 and a second opening portion 168. The first opening portion 166 is set between two mutually opposing first parallel sides 166A and 166B, which are parallel to the direction perpendicular to the control cage cylinder axial center CL.

The second opening portion 168 is set between mutually opposing second two parallel sides 168A and 168B, which are offset relative to the first opening portion 166 on the outer circumferential wall 152A of the control cage 152 in a circumferential direction and in a direction of the cylinder axial center CL of the control cage 152.

The first opening portion 166 and the second opening portion 168 communicate, and approximately half of each overlaps as viewed in a direction along the cylinder axial center CL of the control cage 152.

Also, an opening 170 is through-formed as a projection material discharge portion on the outer circumferential wall 154A of the control cage 154 shown in FIG. 27C.

The opening 170 comprises a first through opening portion 172 and a second opening portion 174. The first opening portion 172 is formed between mutually opposing first parallel sides 172A and 172B, which are parallel to the cylinder axial center CL of the control cage.

Also, the second opening portion 174 is set between mutually opposing second two parallel sides 174A and 174B, which are offset relative to the first opening portion 172 on the outer circumferential wall 154A in circumferential direction and in a direction of the cylinder axial center CL of the control cage 154.

The first opening portion 172 and second opening portion 174 communicate through a third opening portion 176. The third opening portion 176 links the terminus of the side 172A of the first opening portion 172 to the terminus of the side 174A of the second opening portion 174 in a straight line, and links the terminus of the side 172B of the first opening portion 172 to the terminus of the side 174B of the second opening portion 174 in a straight line.

Approximately half of each of the first opening portion 172 and the second opening portion 174 overlaps as seen in a direction along the cylinder axial center CL of the control cage 154.

Also, an opening 178 is through-formed as a projection material discharge portion on the outer circumferential wall 156A of the control cage 156 shown in FIG. 27D.

The opening 178 comprises a first through opening portion 180 and a second opening portion 182. The first opening portion 180 is set between mutually opposing first parallel sides 180A and 180B, which are parallel to the cylinder axial center CL of the control cage.

The second opening portion 182 is set between mutually opposing second two parallel sides 182A and 182B, which are offset relative to the first opening portion 180 in a circumferential direction of the outer circumferential wall 156A of the control cage 156 and in a direction along the cylinder axial center CL direction of the control cage 156.

A first opening portion 180 and second opening portion 182 are somewhat separated in a direction of the cylinder axial center CL when viewed in the direction perpendicular to the cylinder axial center CL of control cage 156 (the direction in FIG. 27D), and approximately half of each overlaps when viewed in a direction of the cylinder axial center CL of the control cage 156.

The first opening portion 180 and second opening portion 182 communicate by means of a third opening portion 184. The third opening portion 184 links the terminus of the side 180A of the first opening portion 180 and the terminus of the side 182A of the second opening portion 182 in a stepped shape, and links the terminus of the side 180B of the first opening portion 180 and the terminus of the side 182B of the second opening portion 182 in a stepped shape.

In a projector comprising the control cages 150, 152, 154, and 156 shown in FIGS. 27A through 27D, projection material respectively discharged from first opening portions 160, 166, 172, and 180 and from second opening portions 162, 168, 174, and 182 is discharged from positions which are offset in the circumferential direction of the control cages 150, 152, 154, and 156. Therefore the projection distribution from these projectors includes the combined distribution made up of the projection distribution of projection material discharged from the first opening portions 160, 166, 172, and 180, and the projection distribution of projection material discharged from the second opening portions 162, 168, 174, and 182.

In a direction of the cylinder axial center CL of the control cages 150, 152, 154, and 156, approximately half of the first opening portions 160, 166, 172, and 180 and the second opening portions 162, 168, 174, and 182 overlap, therefore the projection distributions of projection material respectively discharged from the first opening portions 160, 166, 172, and 180 and the second opening portions 162, 168, 174, and 182 also overlap in approximately half the range of their respective distribution widths. Thus as an overall projection distribution, there is a broadening of the range over which projection quantity is high (the range in which concentrated projection was sought).

Figure 28A:
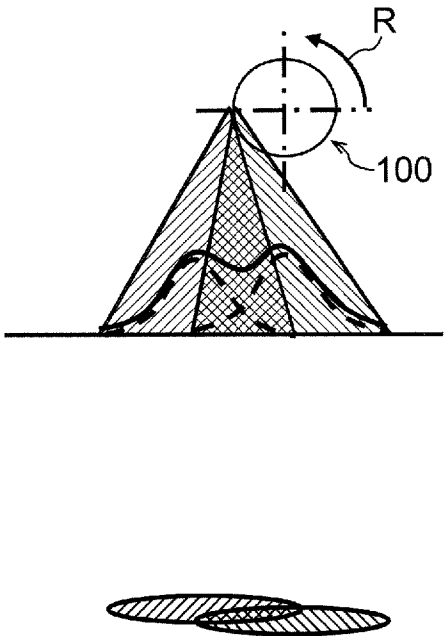
FIG. 28: (A) is a diagram schematically showing the projection distribution and projection range in first and second alternative embodiments; (B) is a diagram schematically showing the projection distribution and projection range in third and fourth alternative embodiments; (C) is a diagram schematically showing the projection distribution and projection range in the fifth alternative embodiment.

FIG. 28A gives an overview of the projection distribution (upper part of the figure) and projection range (lower part of the figure) using a projector comprising control cages 150 and 152 (FIGS. 27A, 27B).

Figure 28B:
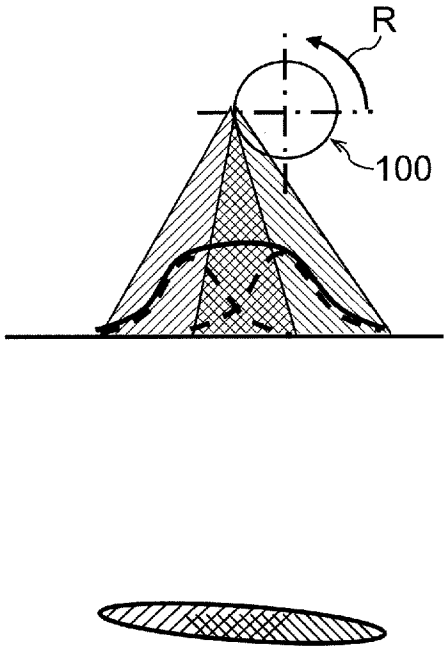

Also FIG. 28B gives an overview of the projection distribution (upper part of the figure) and projection range (lower part of the figure) using a projector comprising control cages 154 and 156 (FIGS. 27C, 27D). It is clear from these figures as well that the area with a large amount of projection material is broadened.

Using the above arrangement, a projector comprising the control cages 150, 152, 154, and 156 shown in FIGS. 27A through 27D can project projection material over a wide angle of 50° to 80°.

This concretely will be explained with reference to the projection distribution graph shown in FIG. 18. In FIG. 18, the plot shown by a double dot and dash line is for the case of a projector comprising the control cage 152 shown in FIG. 27B ("the present embodiment case" below).

As shown in FIG. 18, compared to a comparative example case (see the dotted line), the present embodiment case (double dot and dash line), while having a low projection fraction at 0°, shows a high value for the projection fraction at 0° in the present embodiment compared to the projection fraction at −25° and +25° in the comparative example case. Focusing on the graph to the left of −25° and to the right of +25°, the projection fraction is higher in the range from −25° to −40° and the range from +25° to +40° in the present embodiment than in the comparative example.

Taking that total workpiece processing time is the time until desired polishing and cleaning of the part with the lowest projection fraction is accomplished, and the above analysis, into consideration, it can be seen that when the angle connecting the position of projection material projection by the projector to the position of both edges of the surface facing the projector on a workpiece disposed in the processing position is 50° to 80° when viewed in the impeller rotational direction, the projection fraction effective for surface treatment can be raised more in the present embodiment (solid line) than in the comparative example (dotted line).

When seeking to perform shot processing over a wide area using an air jetting apparatus for jetting compressed air containing projection material from a nozzle, the number of nozzles may increase, or relative movement between the jetting apparatus and the workpiece may increase. This leads to an extremely large increase in power consumption. By contrast, in the present embodiment a centrifugal projector is used, therefore power consumption can be constrained.

Next, a projector (a reference example not included in the present invention) comprising the control cage 158 shown in FIG. 27E will be explained.

An opening 186 is through-formed as a projection material discharge portion on the outer circumferential wall 158A of the control cage 158 shown in FIG. 27E.

Figure 28C:
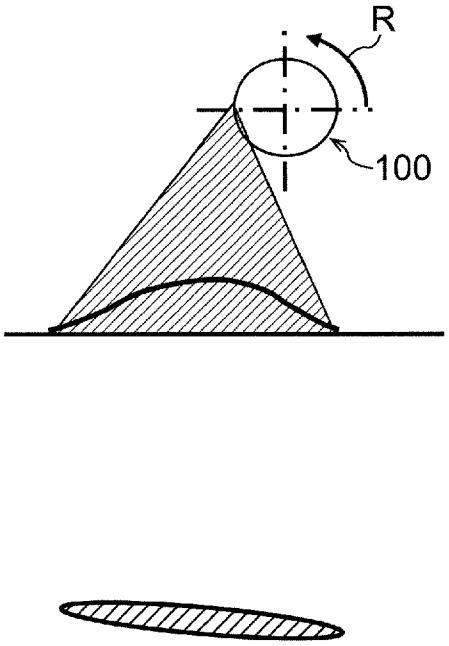

The opening 186 is a parallelepiped opening portion defined by two parallel sides 186A and 186B extending in a direction perpendicular to the cylinder axial center CL of the control cage 158 and opposing one another. FIG. 28C shows a summary view of the projection distribution (upper portion of the figure) and projection range (lower portion of the figure) in a projector comprising a control cage 158 (FIG. 27E).

Figure 29:
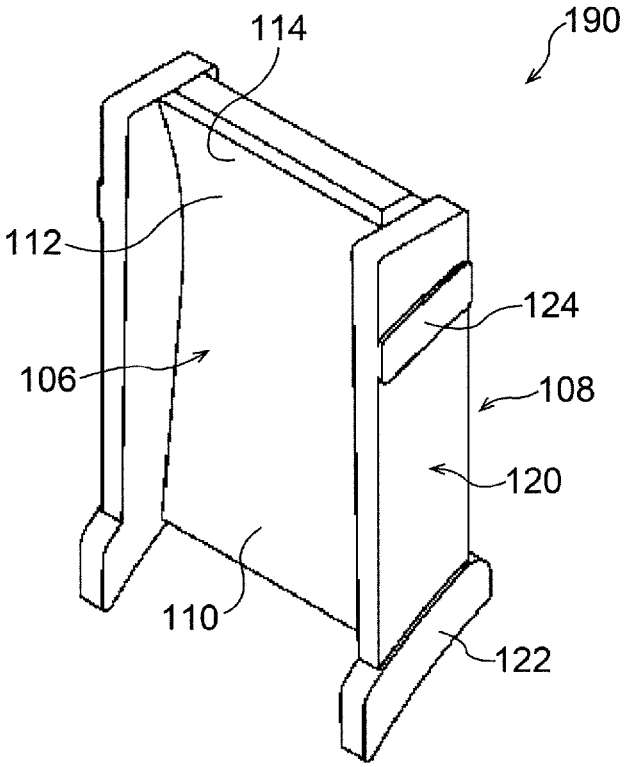
FIG. 29: A perspective view showing blades having other shape.

As the alternatives of each of the embodiments above, it is also possible to use blades 190 shown in FIG. 29 in place of the blades 104. Note that in FIG. 29, the same reference numerals are used for elements which are substantially the same as the blades 104 shown in FIG. 13.

In the embodiment above, the rearward inclining portion 110 shown in FIG. 14 is inclined 40° to the rotationally rearward direction relative to the radial direction of the impeller 100 from the rotational center C; 30° to 50° is preferable, but the inclining angle of the rearward inclining portion may be another angle such as 25° or 55°.

The rearward less-inclining portion on the tip end of the blade surface may be of any type so long as the inclining angle toward the rotationally rearward direction is smaller than that of the rearward inclining portion. In the present specification, the phrase "the inclining angle toward the rotationally rearward direction is smaller than that of the rearward inclining portion" includes cases in which that inclining angle is smaller than the inclining angle of the rearward inclining portion toward the rotationally rearward direction, as well as configurations extending in a radial direction, and configurations inclining toward the rotationally forward direction, therefore a rearward less-inclining portion may be one which extends relative to the radial direction from the impeller rotational center, or one which inclines toward the rotational forward direction relative to the radial direction. It is also acceptable not to provide a rearward less-inclining portion.

Also, the radial length of the rearward inclining portion may be set to be the same as the radial length of the rearward less-inclining portion.

An arrangement in which the rearward inclining portion and the rearward less-inclining portion are directly linked without mediation by a curved portion is also acceptable.

In addition, an arrangement in which no inclining portion is formed is also acceptable.

An arrangement is possible in which no inner lid is provided, such as in cases where an intermediate zone can be established between the loading/unloading zone and the processing zone.

When an intermediate zone can be established between the loading/unloading zone and the processing zone, the projector may be installed on the cabinet side wall portion on the side of the intermediate zone.

The projector 20 impeller may also be set to rotate in the opposite direction from the embodiments above.

In the first embodiment above, the hold-down portion 48 shown in FIG. 5 holds down the workpiece W through a cap 23, but the hold-down portion 48 may take the form of directly holding down the workpiece. In cases such as those in which the workpiece height is low and the workpiece is a standalone item, a mechanism for holding the workpiece may be provided on the work receiving portion 24, without providing a hold-down portion 48.

In a conveyor mechanism comprising a first row conveyor and a second row conveyor, screw conveyors respectively corresponding to the first row conveyor and the second row conveyor may be provided.

It is also acceptable to separately provide an endless belt constituting a first row conveyor, and an endless belt constituting a second row conveyor, driving each endless belt with separate drive motors.

An arrangement is also acceptable in which no partitioning portion 57, shown in FIG. 7B, is provided.

Note that the above-described embodiments or multiple variant examples may be combined as appropriate.

The invention above in reference to embodiments has been explained, but the present invention is not limited to the above embodiments or the like, and may be changed or varied in numerous ways within the scope of the claims.

What is claimed is:

1. A shot processing apparatus comprising:

a centrifugal projector for projecting shot blast materials onto a workpiece;

a support mechanism for supporting the workpiece at a processing position where a surface of the workpiece is treated with the shot blast materials projected by the projector; and a cabinet having (i) a loading/unloading zone at a first height location in which the workpiece is loaded on and unloaded from the shot processing apparatus, and (ii) a processing zone at a second height location in which the workpiece is surface-treated at the processing position with the shot blast materials projected from the projector, wherein the first and second height locations are defined at vertically different locations; and a raising/lowering rotation mechanism provided in the support mechanism, the raising/lowering rotation mechanism being configured to raise and lower the workpiece between the load/unload zone and the processing zone while supporting the workpiece, and rotating about a raising/lowering direction, wherein the projector comprises:

a case provided with a motor operable to rotate around a rotation axis;

a stationary cylindrical control cage provided inside the case coaxially with the rotation axis and stationarily with respect to the case, the stationary control cage being formed with an opening in a circumference of the control cage; and an impeller including a cylindrical hub and multiple blades disposed around the hub at angular intervals, the impeller being provided coaxially with the rotation axis, the hub being provided radially outside the stationary control cage for rotation by the motor relative to the stationary control cage, wherein each of the blades has a front surface facing a rotation direction of the motor, and at least part of each front surface stands inclined at an angle from a radial direction of the hub toward opposite to the rotation direction.

2. The shot processing apparatus of claim 1, wherein the opening is formed in a rectangular shape having two parallel sides parallel to the rotation axis.

3. The shot processing apparatus of claim 1 wherein the at least part of the front surface of each blade is inclined by an angle of 30° to 50° from the radial direction toward opposite to the rotation direction and throws the stop blast materials towards the workpiece within an angular range of about 30°.

4. The shot processing apparatus of claim 1, wherein the front surface of each blade is bifurcated along the radial direction into a first front surface and a second front surface located radially outward of the first front surface, and wherein the first front surface is inclined by a first angle from the radial direction towards opposite to the rotation direction, and the second front surface is included by a second angle smaller than the first angle from the radial direction towards opposite to the rotation direction.

5. The shot processing apparatus of claim 1, wherein the impeller is attached to a rotary shaft of the motor via the hub.

6. The shot processing apparatus of claim 4, wherein the first front surface has a first radial length, and the second front surface has a second radial length shorter than the first radial length.

7. The shot processing apparatus of claim 4, wherein the first and second front surface are connected continuously with a curved surface.

8. The shot processing apparatus of claim 1, further comprising a distributor provided radially inside the stationary control cage coaxially with the rotation axis for rotation by the motor relative to the stationary control cage, the distributor being provided radially outside the control cage with an annular gap present therebetween, the distributor being configured such that during rotation of the motor, the distributor centrifugally pushes the shot blast materials supplied inside the distributor toward radially outside thereof into the annular gap between the distributor and the stationary control cage, wherein the annular gap is dimensioned so that the distributor while rotating moves the shot blast materials to travel along the annular gap relative to the stationary control cage in the rotation direction and throws the travelling shot blast materials out of the opening of the stationary control cage in a direction inclined from the radial direction toward the rotation direction.

9. The shot processing apparatus of claim 8, wherein a rear surface of each blade facing opposite to the rotation direction comprises a rear base surface in a base end portion of the blade, the rear base surface standing inclined at an inclined angle from the radial direction of the hub toward opposite to the rotation direction, the inclined angle being larger than the angle at which the front surface of each blade in the base end portion of the blade stands inclined from the radial direction of the hub toward opposite to the rotation direction.

10. The shot processing apparatus of claim 1, further comprising an inner lid configured to move vertically between a first position located at an upper side of the loading/unloading zone, and a second position located between the loading/unloading zone and the processing zone;

and an elevator mechanism operable to move the inner lid vertically to the first position when the workpiece is loaded or unloaded from the loading/unloading zone, and to the second position when the workpiece is placed in the processing zone.

11. The shot processing apparatus of claim 10, wherein the raising/lowering rotation mechanism has a hold down portion configured to move vertically through the inner lid and operable to hold down the workpiece from above while rotating with the workpiece about the raising/lowering direction.

12. The shot processing apparatus of claim 11, further comprising a workpiece inspection device provided adjacent to the loading/unloading zone, wherein the workpiece inspection device is movable between a retracted position where the workpiece inspection device is laterally inserted between the workpiece and the inner lid when the inner lid and the hold down portion are raised above to separate from the workpiece while supported by the raising/lowering rotation mechanism, and an inspection position located at an extended position, which is lateral to the retracted position, where the workpiece inspection device encompasses the workpiece.

13. The shot processing apparatus of claim 1, wherein the projector is disposed on a side wall of the cabinet adjacent to the processing zone.

14. The shot processing apparatus of claim 13, wherein the impeller of the projector is driven to rotate in a direction in which the impeller blades move downward when they throw the shot blast materials towards the workpiece.

15. The shot processing apparatus of claim 1, further comprising a circulation mechanism operable to bring the shot blast materials, which have been projected by the projector to the workpiece, back to the projector, wherein the circulation mechanism comprises:

a separator having an inlet at a top portion of the circulation mechanism, the inlet being configured to receive a mix of dusts and the shot blast materials already used to treat the workpiece, the separator being operable to separate and remove the dusts from the received mix of dusts and the shot blast materials and discharge the separated shot blast materials from a lower side of the separator;

a shot tank provided adjacent to the inlet of the separator and having a shot supply port at a top of the shot tank, wherein the shot supply port is configured to receive the separated shot blast materials supplied from the separator, and the shot tank is configured to store the received shot blast materials, and a conveyor mechanism having a first row conveyor and a second row conveyor arranged in parallel with the first raw conveyor, the first row conveyor being operable to covey the mix of dusts and the shot blast materials already used to treat the workpiece from a lower portion of the circulation mechanism upward to supply the mix to the inlet of the separator, and the second row conveyor being operable to convey the separated shot blast materials discharged from the separator downward to supply the separated shot blast materials to the shot supply port of the shot tank.

16. The shot processing apparatus of claim 15, wherein the conveyor mechanism comprises a bucket elevator having:

a shared motor operable to drive the first row conveyor and the second row conveyor;

a single endless belt rotationally driven by the motor;

a plurality of first buckets attached to the endless belt in series along a length of the endless belt, wherein the plurality of first buckets form the first row conveyor; and a plurality of second buckets attached to the endless belt in series along the length of the endless belt in parallel with the first buckets, wherein the plurality of second buckets form the second row conveyor.

17. The shot processing apparatus of claim 16, further comprising a partitioning portion stationarily provided adjacent a lower portion of the endless belt, the partitioning portion being formed to pass between the first row conveyor and the second row conveyor while the endless belt operates.

* * * * *